US012740585B2

(12) United States Patent
O'Donnell

(10) Patent No.: US 12,740,585 B2
(45) Date of Patent: Sep. 22, 2026

(54) CONSUMABLE

(71) Applicant: Nicoventures Trading Limited, London (GB)

(72) Inventor: Theresa O'Donnell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 617 days.

(21) Appl. No.: 18/043,083

(22) PCT Filed: Aug. 20, 2021

(86) PCT No.: PCT/GB2021/052167
§ 371 (c)(1),
(2) Date: Feb. 27, 2023

(87) PCT Pub. No.: WO2022/043666
PCT Pub. Date: Mar. 3, 2022

(65) Prior Publication Data
US 2024/0008524 A1 Jan. 11, 2024

(30) Foreign Application Priority Data
Aug. 27, 2020 (GB) ..... 2013489

(51) Int. Cl.
*A24B 15/40* (2006.01)
*A24B 15/167* (2020.01)

(52) U.S. Cl.
CPC ..... *A24B 15/403* (2013.01); *A24B 15/167* (2016.11)

(58) Field of Classification Search
CPC ..... A24B 15/365–403; A24B 15/167
See application file for complete search history.

(56) References Cited

U.S. PATENT DOCUMENTS

| | | | |
|---|---|---|---|
| 2,033,909 | A | 3/1936 | Cox et al. |
| 3,901,248 | A | 8/1975 | Lichtneckert et al. |
| 4,612,942 | A | 9/1986 | Dobberstein et al. |
| 4,660,577 | A | 4/1987 | Sensabaugh et al. |
| 5,387,416 | A | 2/1995 | White et al. |
| 7,025,066 | B2 | 4/2006 | Lawson et al. |

(Continued)

FOREIGN PATENT DOCUMENTS

| | | | |
|---|---|---|---|
| CA | 3096355 | A1 | 10/2019 |
| CN | 1114956 | A * | 11/1996 |

(Continued)

OTHER PUBLICATIONS

Glycoside, Fivable.Inc, [Online], retrieved from the Internet, [retrieved Oct. 27, 2025, <URL:https://fiveable.me/key-terms/organic-chem/glycoside> (Year: 2025).*

(Continued)

*Primary Examiner* — Dennis R Cordray
(74) *Attorney, Agent, or Firm* — WOMBLE BOND DICKINSON (US) LLP; Mark R. DeLuca

(57) ABSTRACT

A consumable for an aerosol provision system, a process for producing the consumable, as well as to an aerosol provision system including said consumable. The consumable includes at least one flavor glycoside, and aerosol-generating material, wherein the consumable has greater than about 15 wt. % water. Also disclosed are various uses of the flavor glycoside.

17 Claims, 2 Drawing Sheets

Specification includes a Sequence Listing.

(56) References Cited

U.S. PATENT DOCUMENTS

| | | | |
|---|---|---|---|
| 7,798,153 | B2 | 9/2010 | Lawrence, Jr. |
| 8,186,360 | B2 | 5/2012 | Marshall et al. |
| 9,738,622 | B2 | 8/2017 | Dull et al. |
| 2004/0191322 | A1 | 9/2004 | Hansson |
| 2016/0185750 | A1 | 6/2016 | Dull et al. |
| 2018/0051002 | A1 | 2/2018 | Dull et al. |
| 2018/0230126 | A1 | 8/2018 | Dull et al. |

FOREIGN PATENT DOCUMENTS

| | | | |
|---|---|---|---|
| CN | 102266125 | B | 1/2013 |
| WO | 97/48295 | A1 | 12/1997 |
| WO | 2014/102070 | A1 | 7/2014 |
| WO | 2015197844 | | 6/2015 |
| WO | 2020089631 | | 10/2019 |
| WO | 2020089633 | | 10/2019 |
| WO | 2020089634 | | 10/2019 |
| WO | 2020089635 | | 10/2019 |
| WO | 2020089636 | | 10/2019 |
| WO | 2020089637 | | 10/2019 |
| WO | 2020089638 | | 10/2019 |
| WO | 2020089639 | | 10/2019 |
| WO | 2020089640 | | 10/2019 |
| WO | 2020089641 | | 10/2019 |

OTHER PUBLICATIONS

Definition of consumable, Cambridge Advanced Learner's Dictionary & Thesaurus, no date, [online], retrieved from the Internet, [retrieved Feb. 21, 2026, <URL https://dictionary.cambridge.org/us/dictionary/english/consumable> (Year: 2026).*

Translation of CN102266125A, European Patent office, [online], retrieved from the Internet, [retrieved Sep. 9, 2025], URL://https://worldwide.espacenet.com/patent/search/family/045048730/publication/CN102266125A?q=pn%3DCN102266125A (Year: 2025).*

International Search Report and Written Opinion received for PCT Patent Application No. PCT/GB2021/052167, mailed on Jan. 7, 2022, 13 pages.

Tobacco Production, Chemistry and Technology, Davis, et al., (Eds.) (1999).

Perfetti, Beitrage Tabakforschung Int., 12: 43-54 (1983).

Goodspeed, The Genus *Nicotiana* (*Chonica botanica*) (1954).

* cited by examiner

A Amino acid sequence of terpene glycosyl transferase VvGT14 (SEQ ID NO: 1)

MGSMEKPHAVCIPYPAQGHINPMLKVAKLLHFRGFRITFVNTEFNHTRLLKAQG
PNSLNG
LPTFQFETIPDGLPPSNVDATQDIPSLCASTKKNCLAPFRRLLAKLNDRGPPVTCIF
SDA
VMSFTLDAAQELGIPDLLLWTASACGFMAYVQYRSLIDKGFTPLKDESYLTNGY
LDTVVD
WIPGMKGIRLKDLPSFIRTTDPDDIMLDFAMGELERARKASAIIFNTFDALEQEVL
DAIA
PMYPPIYTIGPLQLLPDQIHDSELKLIGSNLWKEEPECLKWLDSKEPNSVVYVNY
GSITV
MTPQQLIEFAWGLANSNQSFLWILRPDLVSGESAILPPEFVAETEDRGLLAGWCP
QEQVL
THQAIGGFLTHNGWNSTIEGLCAGVPMICWPFFAEQQTNCRYCCTEWGVGMEID
SDVKRD
EVAKLVRELMVGEKGKVMKKKTMEWKHRAEVATTGPDGSSYLNLEKIFEQVL
L

B Amino acid sequence of terpene glycosyl transferase VvGT15 (SEQ ID NO: 2)

MPRRVVLVPCPFQGHINPMLQLGAILHSRGFSITVAHTQYNSPDPSNHPDFSFLPIP
DGL
SDGQNFASLLNLVLAANVNCESPLREYLAEKQEQHGDIACIIHDITMYFAEAVAN
HLKVP
SINLVTSNVSTTIAHNAFPSLLEKGHIPLQGSTLHDPVPELHPLRFKDLPISRLGDL
EVF
FQILVNMYKKKFSSPIIWNTMDCLEQSSLTQRQQQLQVPFFPIGPLHKLAPPSSSSL
LEE
DSSCITWLDKQSPKSVIYVSWGSLACMDAKDLAEVAWGLANSNQPFLWVVRPG
SVRGSQW
IEQLPETFMDTVGERCHIVKWAPQKEVLGHRAVGGFWSHCGWNSTLESISEGVP
MICRPY
SGDQRVNTRYISHVWKVGLELESDELERVEIERAVRRLMVDGEGEEMRQRAME
LKEKVEI
CTSEGGSSNRALKELVEYISSF

FIGURE 2

CONSUMABLE

PRIORITY CLAIM

The present application is a National Phase entry of PCT Application No. PCT/GB2021/052167, filed Aug. 20, 2021, which claims priority from GB Application No. 2013489.6, filed Aug. 27, 2020, each of which hereby fully incorporated herein by reference.

TECHNICAL FIELD

The present disclosure relates to a consumable for an aerosol provision system, a process for producing the consumable, as well as to an aerosol provision system comprising said consumable.

BACKGROUND

Aerosol provision systems such as electronic cigarettes (e-cigarettes) or tobacco heating products generally contain an aerosolisable material, such as a reservoir of a source liquid containing a formulation, typically including a flavoring agent and optionally an active ingredient such as nicotine, from which an aerosol is generated for inhalation by a user, for example through vaporization. Thus, an aerosol provision system will typically comprise an aerosol generating component such as a heater, arranged to vaporize a portion of aerosolisable material to generate an aerosol in an aerosol generation chamber. Other source materials may be similarly vaporized to create an aerosol, such as botanical matter, or a gel comprising an active ingredient and/or a flavoring.

While a user inhales on the device, electrical power is supplied to the aerosol generating element to vaporize a portion of aerosolisable material to generate an aerosol for inhalation by the user. Such devices are usually provided with one or more air inlet holes located away from a mouthpiece end of the system. When a user sucks on a mouthpiece connected to the mouthpiece end of the system, air is drawn in through the inlet holes and past the aerosol generating component. There is a flow path connecting between the aerosol generating component and an opening in the mouthpiece so that air drawn past the aerosol source continues along the flow path to the mouthpiece opening, carrying some of the aerosol generated by the aerosol generating component with it. The aerosol-carrying air exits the aerosol delivery device through the mouthpiece opening for inhalation by the user.

The user experience of the generated aerosol is therefore important, and consideration should be given to the characteristics of the aerosol produced by the aerosol provision system. These characteristics can include the size of the aerosol particles, the total amount of aerosol produced, the flavor profile of the aerosol generated, etc.

In various instances, it can, for example, be desirable to deliver multiple flavors in a single time period and/or prolong the delivery of a single flavor to a user of the device. Known approaches for delivering multiple flavors include having multiple flavor-containing reservoirs or aerosol sources, but such approaches are complex in terms of manufacture and can require user involvement in order to deliver a particular flavor profile. There is an interest in the ability to formulate aerosolisable or aerosol-generating material so as to deliver a flavor profile without user involvement and thereby improve user satisfaction and experience.

SUMMARY

In accordance with some embodiments described herein, there is provided a consumable for an aerosol provision system comprising (i) at least one flavor glycoside, and (ii) aerosol-generating material, wherein the flavor glycoside comprises a flavoring agent bound to a sugar via a glycosidic bond, and wherein the consumable comprises greater than about 15 wt. % water.

The flavor glycoside may be obtained from a biotechnological process, as discussed herein. The biotechnological process may be an enzymatic process.

In accordance with some embodiments described herein, there is provided a consumable for an aerosol provision system comprising (i) at least one flavor glycoside, and (ii) aerosol-generating material, wherein the flavor glycoside comprises a flavoring agent bound to a sugar via a glycosidic bond, and the flavor glycoside is obtained from a biotechnological process. The consumable may comprise greater than about 15 wt. % water.

The sugar bound to the flavoring agent in the flavor glycoside is not particularly limited, provided that it is able to form a glycosidic bond with the flavoring agent. The sugar may be a monosaccharide or a disaccharide. The sugar may, for instance, be selected from the group consisting of diglycosides, pentoses and hexoses. The sugar may be selected from the group consisting of glucose, fructose, galactose, ribose, deoxy-ribose, xylose, arabinose, alpha-L-arabinofuranose, alpha-L-rhamnopyranose, beta-D-apiofuranose, beta-D-glucopyranose and beta-D-xylopyranose. The sugar may be a monosaccharide selected from the group consisting of glucose and fructose. For example, the flavor glycoside may be a flavor glucoside.

The flavoring agent bound to the sugar in the flavor glycoside is not particularly limited, provided that it is able to form a glycosidic bond with the sugar. The flavoring agent may be selected from the group consisting of terpenes, aliphatic alcohols, aromatic alcohols, pyrones, lactones, phenylpropanoids, and combinations thereof. The flavoring agent may, for example, be selected from the group consisting of geraniol, citronellol, nerol, maltol, ethylmaltol, fenchol, homofuraneol, furaneol, norfuraneol, 1-octen-3-ol, borneol, linalool, farnesol, hydroxycitronellol, 3,7-dimethyloctanol, myrcenol, lavandulol, nerolidol, terpineol, alpha-terpineol, menthol, thymol, carvacrol, myrtenol, carveol, santalol, piperitol, perillyl alcohol, patchouli alcohol, hexanol, 1-hexanol, 3-cis-hexanol, cis-hexen-1-ol, phenylethanol, eugenol, sesamol, sotolone, maple furanone, methyl anthranilate, guaiacol, raspberry ketone, 2-methoxy-4-vinylphenol, 4-ethylguajacol, benzylalcohol, phenylmethanol, vanillin, ethylvanillin, and combinations thereof.

The consumable may comprise greater than about 25 wt. % water, or greater than about 40 wt. % water.

The consumable may further comprise at least one active ingredient. The active ingredient may be present in a lipophilic phase of an emulsion in the consumable, with the at least one flavor glycoside being present in an aqueous phase of said emulsion. The active ingredient may be selected from the group consisting of nicotine, caffeine, taurine, theine, vitamins such as B6 or B12 or C, melatonin, cannabinoids, or constituents, derivatives, or combinations thereof. The active ingredient may, for example, be nicotine. Alternatively, the consumable may be nicotine-free.

The flavor glycoside may be present in an amount of from about 0.001 to about 6 wt. % of the consumable. Other amounts of the flavor glycoside in the consumable are discussed herein.

The consumable may further comprise one or more additional flavoring agents. The one or more additional flavoring agents may be the same or different as the flavoring agent of the flavor glycoside. The rate of release of the flavoring agent in the flavor glycoside may be slower than the rate of release of the one or more additional flavoring agents, wherein the rate of release may be measured as the rate at which a flavoring agent is released during use of the consumable in the aerosol provision system.

As is discussed in more detail below, the consumable may be in the form of a liquid or a gel.

In accordance with some embodiments described herein, there is provided an aerosol provision system comprising the consumable according to the present disclosure. The aerosol provision system may be a non-combustible aerosol provision system. In various embodiments, the non-combustible aerosol provision system may comprise a non-combustible aerosol provision device and the consumable as defined herein.

As described herein, no more than a certain wt. % of the flavoring agent may be released from the flavor glycoside within a specified number of puffs by a user of the aerosol provision system. For example, no more than 10 wt. % of the flavoring agent may be released from the flavor glycoside within about 10 puffs of the aerosol provision system.

As described herein, no more than a certain wt % of the flavoring agent may be released from the flavor glycoside within a certain length of time of the user inhaling on the aerosol provision system. For example, no more than 40 wt % of the flavoring agent may be released from the flavor glycoside within about 5 minutes of the user inhaling on the aerosol provision system. The flavoring agent is believed to be cleaved by salivary enzymes in the oral cavity (e.g. mouth) of a user.

In accordance with some embodiments described herein, there is provided a process for preparing a consumable according to the present disclosure. The process comprises (a) providing aerosol-generating material, and at least one flavor glycoside, wherein the flavor glycoside comprises a flavoring agent bound to a sugar via a glycosidic bond, and (b) contacting the aerosol-generating material and the at least one flavor glycoside to provide the consumable, wherein the consumable comprises greater than about 15 wt. % water.

Alternatively the process comprises (a) providing aerosol-generating material, and at least one flavor glycoside, wherein the flavor glycoside comprises a flavoring agent bound to a sugar via a glycosidic bond and the flavor glycoside is obtained from a biotechnological process, and (b) contacting the aerosol-generating material and the at least one flavor glycoside to provide the consumable.

In accordance with some embodiments described herein, there is provided the use of a flavor glycoside to prolong flavor of a consumable in an aerosol provision system, wherein the flavor glycoside comprises a flavoring agent bound to a sugar via a glycosidic bond. The consumable may be defined according to the present disclosure. The flavor may be delivered to the user for a minimum number of puffs or a % of total available puffs, e.g. at least about puffs, when the consumable is used in an aerosol provision system as described herein.

The flavor delivery may alternatively be defined by a wt % over a period of time as described herein.

In accordance with some embodiments described herein, there is provided the use of a flavor glycoside to change the flavor released from a consumable in an aerosol provision system over a period of time, wherein the consumable comprises a flavor glycoside and one or more additional flavoring agents, wherein the flavor glycoside comprises a flavoring agent bound to a sugar via a glycosidic bond and wherein the one or more additional flavoring agents is distinct from the flavoring agent in the flavor glycoside. The consumable may be defined according to the present disclosure.

The one or more additional flavoring agents may be experienced by a user during use of the aerosol provision system prior to the flavoring agent from flavor glycoside. For example, the additional flavoring agent may be aerosolized by the aerosol provision system prior to the flavor glycoside, it being understood that the glycosidic bond of the flavor glycoside is subsequently cleaved by one or more enzymes in the user's oral cavity to release the flavoring agent.

In accordance with some embodiments described herein, there is provided the use of a flavor glycoside to increase the water solubility of a flavoring agent in a consumable for an aerosol provision system, wherein the flavor glycoside comprises a flavoring agent bound to a sugar via a glycosidic bond. The consumable may be defined according to the present disclosure. The increase in water solubility may be defined as being relative to the flavoring agent not being formed as a flavor glycoside, i.e. not being bound to the sugar via a glycosidic bond.

In accordance with some embodiments described herein, there is provided the use of a flavor glycoside to extend the shelf-life of a flavoring agent in a consumable for an aerosol provision system, wherein the flavor glycoside comprises a flavoring agent bound to a sugar via a glycosidic bond.

Shelf life is typically the length of time that a consumer product may be stored without becoming unfit for use, consumable or sale. By the expression "extending the shelf life" is therefore meant that the flavor glycoside allows the consumable to be stored for a longer period of time without degradation of the flavoring agent contained therein compared to a similar formulation with the flavoring agent in its standard form, i.e. not bound to a sugar via a glycosidic bond. Typical storage conditions include ambient temperature and pressure.

These and other features, aspects, and advantages of the disclosure will be apparent from a reading of the following detailed description together with the accompanying drawings, which are briefly described below. The invention includes any combination of two, three, four, or more of the above-noted features as well as combinations of any two, three, four, or more features or elements set forth in this disclosure, regardless of whether such features or elements are expressly combined in a specific embodiment description herein. This disclosure is intended to be read holistically such that any separable features or elements of the disclosure, in any of its various aspects and embodiments, should be viewed as intended to be combinable unless the context clearly dictates otherwise.

For ease of reference, these and further aspects of the present disclosure are now discussed under appropriate section headings. However, the teachings under each section are not necessarily limited to each particular section.

BRIEF DESCRIPTION OF THE DRAWINGS

Figure 1:
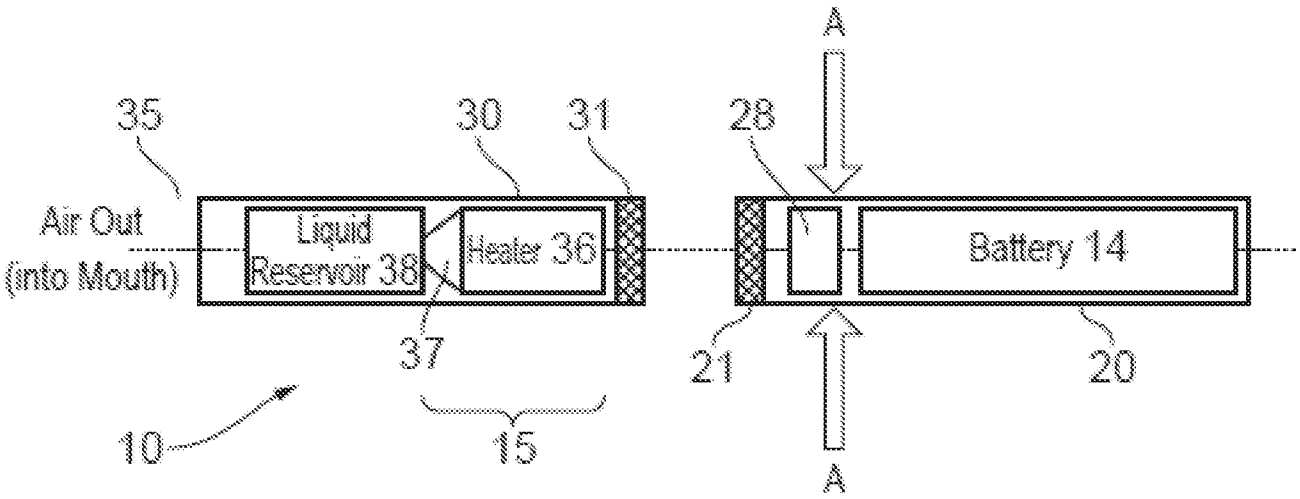

Having thus described aspects of the disclosure in the foregoing general terms, reference will now be made to the accompanying drawings, which are not necessarily drawn to scale. The drawings are exemplary only, and should not be construed as limiting the disclosure.

FIG. 1 is a schematic representation of an electronic aerosol delivery system.

FIG. 2 shows the amino acid sequences of terpene glycosyl transferases VvGT14 and VvGT15 from *Vitis vinifera*. (A): Amino acid sequence of terpene glycosyl transferase VvGT14 (SEQ ID NO: 1). (B): Amino acid sequence of terpene glycosyl transferase VvGT15 (SEQ ID NO: 2).

DETAILED DESCRIPTION

In the following description, a number of specific details are presented in order to provide a thorough understanding of the embodiments of the present disclosure. It is, however, to be understood that this disclosure is not limited to these specific details. It is also to be understood that the terminology employed herein is used for the purpose of describing particular embodiments only and is not intended to be limiting since the scope of the present disclosure will be limited only by the appended claims and equivalents thereof. It will also be apparent that specific details known to the person skilled in the art are omitted for the purposes of clarity where appropriate.

As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). Reference to "wet weight" refers to the weight of the consumable including water. Unless otherwise indicated, reference to "weight percent" (or "% by weight") of a consumable reflects the total wet weight of the consumable (i.e., including water).

In this specification, unless otherwise stated, the term "about" modifying the quantity of an ingredient refers to variation in the numerical quantity that can occur, for example, through typical measuring and liquid handling procedures used for making concentrates or solutions in the real world; through inadvertent error in these procedures; through differences in the manufacture, source, or purity of the ingredients employed, or to carry out the methods; and the like. The term "about" also encompasses amounts that differ due to different equilibrium conditions for a consumable resulting from a particular initial mixture. Whether or not modified by the term "about", the claims include equivalents to the quantities.

The ranges provided herein provide exemplary amounts of each of the components. Each of these ranges may be taken alone or combined with one or more other component ranges.

Consumable

As described above, the present disclosure relates to a consumable for an aerosol provision system. A consumable is an article comprising or consisting of aerosol-generating material and at least one flavor glycoside, part of all of which is intended to be consumed during use of the aerosol-provision system by a user. In various embodiments the consumable does not include a housing and corresponds to a composition comprising of aerosol-generating material and at least one flavor glycoside.

The aerosol-generating material is a material that is capable of generating aerosol, for example, when heated, irradiated or energized in any other way. Aerosol-generating material may, for example, be in the form of a solid, liquid or gel, which may or may not contain an active substance or ingredient. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about wt. %, 60 wt. %, or 70 wt. % of amorphous solid, to about 90 wt. %, 95 wt. %, or 100 wt. % of amorphous solid.

The aerosol-generating material may comprise one or more active ingredients as defined herein, one or more additional flavoring agents as defined herein, one or more aerosol-former materials as defined herein, and optionally one or more other functional material as defined herein.

The aerosol-former material may comprise one or more constituents capable of forming an aerosol. In some embodiments, the aerosol-former material may comprise one or more of glycerol, propylene glycol, diethylene glycol, triethylene glycol, tetraethylene glycol, 1,3-butylene glycol, erythritol, meso-erythritol, ethyl vanillate, ethyl laurate, a diethyl suberate, triethyl citrate, triethylene glycol diacetate, triacetin, a diacetin mixture, benzyl benzoate, benzyl phenyl acetate, tributyrin, lauryl acetate, lauric acid, myristic acid, and propylene carbonate. In some embodiments, the aerosol-former material comprises propylene glycol. In some embodiments, the aerosol-former material comprises glycerol, for example propylene glycol, glycerol or a mixture thereof.

In one embodiment, the aerosol-former material is present in an amount of from 10% w/w to 95% w/w based on the total weight of the consumable. In one embodiment, aerosol-former material is present in an amount of from 20% w/w to 95% w/w based on the total weight of the consumable. In one embodiment, aerosol-former material is present in an amount of from 30% w/w to 95% w/w based on the total weight of the consumable. In one embodiment, aerosol-former material is present in an amount of from 40% w/w to 95% w/w based on the total weight of the consumable.

In one embodiment, aerosol-former material is present in an amount of from 50% w/w to 90% w/w based on the total weight of the consumable. In one embodiment, aerosol-former material is present in an amount of from 50% w/w to 85% w/w based on the total weight of the consumable. In one embodiment, aerosol-former material is present in an amount of from 50% w/w to 80% w/w based on the total weight of the consumable. In one embodiment, aerosol-former material is present in an amount of from 50% w/w to 75% w/w based on the total weight of the consumable.

It will be understood by the skilled person that when the consumable includes water, for example, at an amount of greater than about 15 wt %, the amount of aerosol-former material will be adjusted accordingly.

In one embodiment, aerosol-former material is present in an amount of at least 10% w/w based on the total weight of the consumable. In one embodiment, aerosol-former material is present in an amount of at least 20% w/w based on the total weight of the consumable. In one embodiment, aerosol-former material is present in an amount of at least 30% w/w based on the total weight of the consumable. In one embodiment, aerosol-former material is present in an amount of at least 40% w/w based on the total weight of the consumable. In one embodiment, aerosol-former material is present in an amount of at least 50% w/w based on the total weight of the consumable. In one embodiment, aerosol-former material is present in an amount of at least 55% w/w based on the total weight of the consumable. In one embodiment, aerosol-former material is present in an amount of at least 60% w/w based on the total weight of the consumable. In one embodiment, aerosol-former material is present in an amount of at least 65% w/w based on the total weight of the consumable. In one embodiment, aerosol-former material is present in an amount of at least 70% w/w based on the total weight of the consumable. In one embodiment, aerosol-former material is present in an amount of at least 75% w/w based on the total weight of the consumable. In one embodiment, aerosol-former material is present in an amount of at least 80% w/w based on the total weight of the consumable. In one embodiment, aerosol-former material is present in an amount of at least 85% w/w based on the total weight of the consumable. In one embodiment, aerosol-former material is present in an amount of at least 90% w/w based on the total weight of the consumable.

In one embodiment, both glycerol and propylene glycol are present as aerosol-former materials in the consumable. For example, glycerol and propylene glycol may be present in the consumable in the following amounts: 60 to 90% w/w propylene glycol; and 40 to 10% w/w glycerol, based on the total weight of glycerol and propylene glycol present in the material. In one embodiment, glycerol and propylene glycol are present in the consumable in the following amounts: 70 to 80% w/w propylene glycol, and 30 to 20% w/w glycerol, based on the total weight of glycerol and propylene glycol present in the consumable.

In one embodiment, the consumable is a liquid at about 25° C.

The one or more other functional materials may comprise one or more of pH regulators, coloring agents, preservatives, binders, fillers, stabilizers, and/or antioxidants. In particular, the pH regulator may include one or more acids selected from organic or inorganic acids. An example of an inorganic acid is phosphoric acid. The organic acid may include a carboxylic acid. The carboxylic acid may be any suitable carboxylic acid. In one embodiment, the acid is a monocarboxylic acid. In one embodiment, the acid may be selected from the group consisting of acetic acid, lactic acid, formic acid, citric acid, benzoic acid, pyruvic acid, levulinic acid, succinic acid, tartaric acid, oleic acid, sorbic acid, propionic acid, phenylacetic acid, and mixtures thereof.

The aerosol-generating material may be present on or in a substrate. The substrate may, for example, be or comprise paper, card, paperboard, cardboard, reconstituted material, a plastics material, a ceramic material, a composite material, glass, a metal, or a metal alloy. In some embodiments, the substrate comprises a susceptor. In some alternative embodiments, the susceptor is on one or either side of the material.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

The substrate may be a solid, liquid or gel. In various embodiments of the present disclosure, the substrate material is a solid or a gel. The substrate material may for example, be a fibrous material, such as a material selected from the group consisting of paper, tobacco, non-tobacco plant material (e.g. cellulose) or combinations thereof.

The tobacco material may be prepared from any type or form of tobacco. The present disclosure is not limited in this respect. Generally, the tobacco material is obtained from a harvested plant of the *Nicotiana* species. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.* x *sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii.*

Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Descriptions of various types of tobaccos, growing practices and harvesting practices are set forth in *Tobacco Production, Chemistry and Technology*, Davis et al. (Eds.) (1999), which is incorporated herein by reference.

Various parts or portions of the plant of the *Nicotiana* species can be included within a tobacco material as disclosed herein. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment.

When nicotine is present in the consumable, it may be added or may be inherently present if the substrate material is a tobacco substrate material. In one embodiment the substrate material includes at least one tobacco substrate material. The tobacco substrate material may be solid, liquid or gel. In one embodiment, the tobacco substrate material is solid. The identity of the tobacco is not limited; it can be any type or grade of tobacco and includes any part, such as for example, the leaves or stems of any member of the genus *Nicotiana* and reconstituted materials thereof. In one embodiment, the tobacco is from the species *Nicotiana tabacum*. The tobacco substrate material may be from one variety of tobacco or from more than one variety of tobacco. As is known in the art, the latter can be referred to as a blend. Examples of tobacco varieties which may be used include, but are not limited to, Virginia, Burley, Oriental and *Rustica* tobaccos.

In one embodiment the tobacco substrate material is a pH-treated tobacco material; pH treatment of tobacco is well known in the art. In general, pH treatment raises the pH of the tobacco material from an acidic pH to an alkaline pH. The tobacco substrate material, including when the tobacco substrate material is a pH-treated tobacco material, can be in any suitable form. In one embodiment, the tobacco substrate material is in the form of particles, beads, granules or the like. The shape and/or size of such particles, beads or granules is not limited in the context of the present invention. The skilled person will be aware of suitable sizes and shapes and the methods by which such sizes and shapes can be achieved.

Flavor Glycoside

In addition to the aerosol-generating material, the consumable comprises at least one flavor glycoside. As used herein, the term "flavor glycoside" refers to a compound in which a flavoring agent is bound to a sugar molecule via a glycosidic bond.

The glycosidic bond may be an O-, N-, S- or C-glycosidic bond. An O-glycosidic bond is formed between the anomeric carbon on the sugar and a hydroxyl group on the flavoring agent. An N-glycosidic bond is formed between the anomeric carbon on the sugar and an amino group on the flavoring agent.

Flavor glycosides as used herein may be prepared using any methods known to the person skilled in the art. For example, the flavor glycoside may be produced by synthetic (i.e. chemical) methods or may be produced by a biotechnological process. As the skilled person is aware, industrial production of glycosides may carried out by the Koenig's-Knorr process (i.e. organic-chemical substitution of a glycosyl halide with an alcohol to yield a glycoside) or reversed enzymatic hydrolysis or transglycosylation employing glycosidases. The flavor glycoside is free from compounds originating from an extract of a natural plant.

In some embodiments, the flavor glycoside is not produced by synthetic or chemical methods.

Biotechnological Process for Preparing Flavor Glycoside

In accordance with a first embodiment described herein, the at least one flavor glycoside may be obtained from a biotechnological process. This biotechnological process may be an enzymatic process, such as a process involving a glycosyltransferase.

The flavor glycoside obtained from a biotechnological process may be a flavor glycoside that is commercially available from 4Gene GmbH. For example, the flavor glycoside obtained from a biotechnological process may be a flavor glucoside that is commercially available from 4Gene GmbH.

The biotechnological process used to prepare the flavor glycoside may be as described in WO 2015/197844, the entirety of which is hereby expressly incorporated by reference. The flavor glycoside may be prepared by contacting a flavoring agent with a sugar donor and a glycosyl transferase under conditions appropriate for the transfer of the sugar group of the sugar donor to a hydroxyl group, or other suitable functional group, on the flavoring agent. The glycosyl transferase may be a recombinantly expressed glycosyl transferase.

For example, the methods described in Example 1 of WO 2015/197844, the entirety of which is hereby incorporated, can be used to produce the flavor glycoside as described herein.

As the skilled person will appreciate, in embodiments wherein the flavor glycoside comprises a sugar that is a disaccharide, oligosaccharide or polysaccharide, the enzymatic process may include the same steps as for a monosaccharide, but in which the steps are repeated the corresponding number of times as for the number of saccharide units. For example, whilst the preparation of a flavor glycoside in which the sugar is a monosaccharide may include the above-mentioned steps, the preparation of a flavor glycoside in which the sugar is a disaccharide may comprise the same steps as for the monosaccharide but in which these are repeated twice.

The glycosyl transferase may have an amino acid sequence that (a) comprises the sequence of SEQ ID NO: 1 (see FIG. 2); or (b) comprises a sequence that is at least 90%, preferably at least 95%, more preferably at least 98%, identical to SEQ ID NO: 1; or (c) comprises a part of the sequence of SEQ ID NO: 1, wherein, preferably, said part of the sequence of SEQ ID NO: 1 is at least 50, preferably at least 80, more preferably at least 100, more preferably at least 200, amino acids in length; or (d) comprises a sequence that is at least 90%, preferably at least 95%, more preferably at least 98%, identical to a part of the sequence of SEQ ID NO: 1, wherein, preferably, said part of the sequence of SEQ ID NO: 1 is at least 50, preferably at least 80, more preferably at least 100, more preferably at least 200, amino acids in length; or (e) comprises the sequence of SEQ ID NO: 2 (see FIG. 2); or (f) comprises a sequence that is at least 90%, preferably at least 95%, more preferably at least 98%, identical to SEQ ID NO: 2; or (g) comprises a part of the sequence of SEQ ID NO: 2, wherein, preferably, said part of the sequence of SEQ ID NO: 2 is at least 50, preferably at least 80, more preferably at least 100, more preferably at least 200, amino acids in length; or (h) comprises a sequence that is at least 90%, preferably at least 95%, more preferably at least 98%, identical to a part of the sequence of SEQ ID NO: 2, wherein, preferably, said part of the sequence of SEQ ID NO: 2 is at least 50, preferably at least 80, more preferably at least 100, more preferably at least 200, amino acids in length.

The glycosyl transferase may be a small molecule glycosyl transferase. In some embodiments, the glycosyl transferase is a terpene glycosyl transferase, preferably a monoterpene glycosyl transferase, more preferably a UDP-glucose mono terpene β-D-glucosyltransferase. In some embodiments, said glycosyl transferase is capable of using UDP-glucose as sugar donor. Preferably, said glycosyl transferase uses UDP-glucose more efficiently as sugar donor than UDP-xylose, UDP-glucuronic acid, UDP-arabinose, UDP-rhamnose, UDP-galactose, GDP-fucose, GDP-mannose and/or CMP-sialic acid, as seen by radiochemical analysis. In such radiochemical analysis, individual reactions are carried out in which different radiolabelled sugar donors (such as radiolabelled UDP-glucose, UDP-xylose and UDP-glucuronic acid) that carry a radionuclide in their sugar group are reacted under appropriate conditions and in the presence of the glycosyl transferase with a certain acceptor molecule. By comparing the amount of radiolabel that was transferred from the different sugar donors to the acceptor molecule, it can be determined which sugar donor the glycosyl transferase uses more efficiently than the others.

In some embodiments, the glycosyl transferase is capable of catalyzing transfer of a sugar group from a sugar donor to a hydroxyl group of a hydroxy-containing terpene and/or a carboxyl group of a carboxy-containing terpene. In some embodiments, the glycosyl transferase is capable of catalyzing formation of a glycoside in which a sugar is linked to a hydroxy-containing terpene through a β-D-glycosyl linkage and/or formation of a glycose ester in which a sugar is linked to a carboxy-containing terpene through a β-D-glycose ester linkage.

In some embodiments, the glycosyl transferase is capable of catalyzing glycosylation, preferably glucosylation, of geraniol, (R-)linalool, (R- and/or S-)citronellol, nerol, hexanol and/or octanol, preferably geraniol and/or (R- and/or S-)citronellol, wherein, preferably, said glycosyl transferase has an amino acid sequence as defined above in (a) to (d). Namely said glycosyl transferase has an amino acid sequence that (a) comprises the sequence of SEQ ID NO: 1; or (b) comprises a sequence that is at least 90%, preferably at least 95%, more preferably at least 98%, identical to SEQ ID NO: 1; or (c) comprises a part of the sequence of SEQ ID NO: 1, wherein, preferably, said part of the sequence of SEQ ID NO: 1 is at least 50, preferably at least 80, more preferably at least 100, more preferably at least 200, amino acids in length; or (d) comprises a sequence that is at least 90%, preferably at least 95%, more preferably at least 98%, identical to a part of the sequence of SEQ ID NO: 1, wherein, preferably, said part of the sequence of SEQ ID NO: 1 is at least 50, preferably at least 80, more preferably at least 100, more preferably at least 200, amino acids in length.

In some embodiments, the glycosyl transferase is capable of catalyzing glycosylation, preferably glucosylation, of furaneol, wherein, preferably, said glycosyl transferase has an amino acid sequence as defined above in (a) to d), i.e. that (a) comprises the sequence of SEQ ID NO: 1; or (b) comprises a sequence that is at least 90%, preferably at least 95%, more preferably at least 98%, identical to SEQ ID NO: 1; or (c) comprises a part of the sequence of SEQ ID NO: 1, wherein, preferably, said part of the sequence of SEQ ID NO: 1 is at least 50, preferably at least 80, more preferably at least 100, more preferably at least 200, amino acids in length; or (d) comprises a sequence that is at least 90%, preferably at least 95%, more preferably at least 98%), identical to a part of the sequence of SEQ ID NO: 1, wherein, preferably, said part of the sequence of SEQ ID NO: 1 is at least 50, preferably at least 80, more preferably at least 100, more preferably at least 200, amino acids in length.

The glycosyl transferase may be capable of catalyzing glycosylation, preferably glucosylation, of eugenol, wherein, preferably, said glycosyl transferase has an amino acid sequence as defined above in (a) to (d), i.e. that (a) comprises the sequence of SEQ ID NO: 1; or (b) comprises a sequence that is at least 90%, preferably at least 95%, more preferably at least 98%, identical to SEQ ID NO: 1; or (c) comprises a part of the sequence of SEQ ID NO: 1, wherein, preferably, said part of the sequence of SEQ ID NO: 1 is at least 50, preferably at least 80, more preferably at least 100, more preferably at least 200, amino acids in length; or (d) comprises a sequence that is at least 90%, preferably at least 95%, more preferably at least 98%, identical to a part of the sequence of SEQ ID NO: 1, wherein, preferably, said part of the sequence of SEQ ID NO: 1 is at least 50, preferably at least 80, more preferably at least 100, more preferably at least 200, amino acids in length.

In some embodiments, the glycosyl transferase is capable of catalyzing glycosylation, preferably glucosylation, of geraniol, (R- and/or S-)citronellol, nerol, hexanol, octanol, 8-hydroxylinalool, trans 2-hexenol, and/or farnesol, preferably geraniol, wherein, preferably, said glycosyl transferase has an amino acid sequence as defined in (d) to (h) above, i.e. that (d) comprises a sequence that is at least 90%), preferably at least 95%, more preferably at least 98%, identical to a part of the sequence of SEQ ID NO: 2, wherein, preferably, said part of the sequence of SEQ ID NO: 2 is at least 50, preferably at least 80, more preferably at least 100, more preferably at least 200, amino acids in length; (e) comprises the sequence of SEQ ID NO: 2; or (f) comprises a sequence that is at least 90%, preferably at least 95%, more preferably at least 98%, identical to SEQ ID NO: 2; or (g) comprises a part of the sequence of SEQ ID NO: 2, wherein, preferably, said part of the sequence of SEQ ID NO: 2 is at least 50, preferably at least 80, more preferably at least 100, more preferably at least 200, amino acids in length; or (h) comprises a sequence that is at least 90%, preferably at least 95%, more preferably at least 98%, identical to a part of the sequence of SEQ ID NO: 2, wherein, preferably, said part of the sequence of SEQ ID NO: 2 is at least 50, preferably at least 80, more preferably at least 100, more preferably at least 200, amino acids in length.

Also described herein is an (isolated) nucleic acid molecule encoding a glycosyl transferase as defined in any of the embodiments described above, wherein, preferably, said nucleic acid molecule is a DNA molecule.

Also described herein is a vector comprising a DNA sequence encoding a glycosyl transferase as defined in any of the embodiments described above. The vector may be an expression vector, preferably an expression vector for expression of a glycosyl transferase as defined in any of the embodiments described above.

Also described herein is a host cell containing or transfected with the nucleic acid molecule as described above or the vector as described above, wherein, preferably, said host cell is not a cell of *Vitis vinifera*, more preferably not a cell of a grape vine, and/or wherein, preferably, said host cell is a non-human cell, preferably a bacterial cell, more preferably an *E. coli* cell. In some embodiments, said host cell produces/expresses a glycosyl transferase as defined in any of the embodiments above.

Also described herein is a transgenic plant comprising a nucleic acid molecule as defined above or a vector as defined above, wherein, preferably, said plant is not a *Vitis vinifera* plant, more preferably not a grape vine. In some embodiments, said transgenic plant produces/expresses a glycosyl transferase as defined in any of the embodiments above.

As described herein, the glycosyl transferase as defined in any of the embodiments above or a nucleic acid molecule as defined above or a vector as defined above or a host cell as defined above or a transgenic plant as defined above may be used for producing a flavor glycoside, such as for example a terpene glycoside, an octanyl glycoside, furanyl glycoside or hexanyl glycoside.

The production of said flavor glycoside may not involve steps carried out in vivo. In some embodiments, said production of the flavor glycoside is carried out in a host cell or transgenic plant as defined above, preferably in an *E. coli* cell.

In some embodiments, the sugar group of the flavor glycoside is glucose and the sugar donor used in the method of production is UDP-glucose.

In some embodiments, the method for producing the flavor glycoside is an in vitro method which does not involve any steps carried out in vivo. In some embodiments, said method is an in vivo method carried out in a host cell or transgenic plant. In some embodiments, said method may be an in vivo method carried out in *E. coli*.

In some embodiments, the biotechnological method of obtaining the flavor glycoside may comprise the steps of: culturing or growing a host cell as defined above or a transgenic plant as defined above; and collecting from said host cell or transgenic plant the flavor glycoside.

The flavor glycoside may be a flavor glycoside in which a hydroxy-containing flavoring agent is covalently linked to a sugar group. In some embodiments, during said culturing or growing said host cell or transgenic plant said hydroxy-containing flavoring agent is present in said host cell or transgenic plant. In some embodiments, during said culturing or growing said host cell or transgenic plant UDP-glucose is present in the culture medium used for culturing said host cell or in the water used for watering that transgenic plant.

In some embodiments, said culturing or growing said host cell is carried out in a bioreactor. A "bioreactor" is a vessel in which a (bio)chemical process is carried out which involves organisms (such as host cells) or biochemically active substances derived from such organisms.

Also described herein is a method of producing a protein having glycosyl transferase activity and/or enzymatic activity for the catalysis of glycose esterification, said method comprising the steps of:

culturing or growing a host cell as defined above or a transgenic plant as above; and, preferably, collecting from the host cell or transgenic plant a protein having glycosyl transferase activity and/or enzymatic activity for the catalysis of glycose esterification.

In some embodiments, said glycosyl transferase activity is an activity of transferring the sugar group of a sugar donor to a hydroxyl group of a hydroxy-containing flavoring agent under formation of a glycosidic bond between said hydroxy-containing flavoring agent and said sugar group.

The protein having glycosyl transferase activity and/or enzymatic activity for the catalysis of glycose esterification may be a glycosyl transferase as defined in any of the embodiments above. A "glycosyl transferase" in an enzyme of EC class 2.4 that catalyzes the transfer of a monosaccharide moiety from a sugar donor to an acceptor molecule under formation of a glycosidic linkage between the sugar (the glycone) and the acceptor molecule (the aglycone) (see, e.g., Bowles et al., 2006). The sugar donor may be an activated sugar precursor and can be, for example, UDP (uridine diphosphate)-glucose wherein the sugar is glucose, UDP-xylose wherein the sugar is xylose, UDP-glucuronic acid wherein the sugar is glucuronic acid, UDP-arabinose wherein the sugar is arabinose, UDP-rhamnose wherein the sugar is rhamnose, UDP-galactose wherein the sugar is galactose, GDP (guanosine diphosphate)-fucose wherein the sugar is fucose, GDP-mannose wherein the sugar is mannose or CMP (cytidine monophosphate)-sialic acid wherein the sugar is sialic acid. If the glycosyl transferase is a glucosyl transferase, then the sugar donor is UDP-glucose.

The acceptor molecule may be an alcohol (OH group), such as the alcohol of a terpenoid, alkaloid, cyanohydrin, glucosinolate, flavonoid, isoflavonoid, anthocyanidin, phenylpropanoid, polyphenol, hydroquinone, amine, carbohydrate (monomeric or oligomeric), fatty acid or lipids. Examples of glycosyl transferases are UDP-glucosyltransferases, UDP-arabinosyltransferases, UDP-glucuronosyltransferases, UDP-xylosyltransferases, UDP-galactosyltransferases, UDP-rhamnosyltransferases, GDP-fucosyltransferase, GDP-mannosyltransferase, or CMP-sialyltransferase. A glycosyl transferase may or may not have an additional enzymatic activity for the catalysis of glycose esterification, i.e. for transferring the sugar group of a sugar donor to a carboxyl group of a carboxy-containing acceptor molecule under formation of a glycose ester bond between said carboxy-containing acceptor molecule and said sugar group.

A "small molecule glycosyl transferase" is a glycosyl transferase that catalyzes the transfer of a monosaccharide moiety from a sugar donor to a small molecule as acceptor molecule. A small molecule is a molecule that has a molecular weight below 1 500 Dalton, preferably below 1 000 Dalton. A "flavoring agent glycosyl transferase" is a glycosyl transferase that catalyzes the transfer of a monosaccharide moiety from a sugar donor to a flavoring agent as acceptor molecule. A "terpene glycosyl transferase" is a glycosyl transferase that catalyzes the transfer of a monosaccharide moiety from a sugar donor to a terpene as acceptor molecule. A "monoterpene glycosyl transferase" is a glycosyl transferase that catalyzes the transfer of a monosaccharide moiety from a sugar donor to a monoterpene as acceptor molecule. An "UDP-glucose:monoterpene β-D-glucosyltransferase" is a glycosyl transferase that catalyzes the transfer of a glucose moiety from a UDP-glucose as sugar donor to a monoterpene as acceptor molecule under formation of covalent a β-D-glycosidic bond.

Reference is made herein to a glycosyl transferase "having" a certain amino acid sequence. This is meant to designate that the amino acid sequence of said glycosyl transferase consists of said certain amino acid sequence, i.e. the glycosyl transferase has only said certain amino acid sequence and no further amino acid sequence(s) beyond said certain amino acid sequence. Glycosyl transferases having an amino acid sequence comprising SEQ ID NO: 1 (i.e. the sequence of VvGT14) or SEQ ID NO: 2 (i.e. the sequence of VvGT15) or a related amino acid sequence can be obtained by standard methods of recombinant DNA technology, for example as described in Example 1 of WO 2015/197844, which is hereby incorporated by reference in its entirety.

A "glycoside", as used herein, is a molecule in which a sugar (the "glycone" part or "glycone component" of the glycoside) is bonded to a non-sugar (the "aglycone" part or "aglycone component") via a glycosidic bond. Accordingly, a glycoside may consist of a sugar as glycone component (designated "Z" in the general chemical structure below) linked through its anomeric carbon atom to the hydroxy group of an alcohol (chemical structure R—OH) as aglycone component, thus resulting in a glycoside of the general chemical structure R—O—Z. For example, in the glycoside linaloyl β-D-glucoside, the glycone component glucose is linked to the aglycone component linalool.

A glycoside can be produced by carrying out a reaction in which an aglycone component (such as a terpene, for example geraniol or citronellol) is mixed under appropriate conditions with a sugar donor (an activated sugar precursor such as UDP-glucose or UDP-glucuronic acid, preferably UDP-glucose) in the presence of a glycosyl transferase as enzymatic catalyzer. For example, 100 μL purified enzyme (50 μg), 100-150 μL Tris-HCl buffer (100 mM, pH 7.5, 10 mM 2-mercaptoethanol), 37 pmol UDP-glucose and 50 μg substrate (dissolved in methyl-tert-butylether) can be incubated at 30° C. for 24 hr. This results in the formation of glycosides composed of an aglycone component linked to a glycone component. The glycoside can subsequently be isolated from the reaction mixture by standard methods of extraction and chromatography (see also Example 1 of WO 2015/197844, which is hereby incorporated by reference in its entirety).

Alternatively, a glycoside can be produced by culturing or growing a host cell or transgenic plant expressing a glycosyl transferase as described herein. During culture/growth, such a host cell or transgenic plant will generate glycosides. The glycoside(s) generated in such a host cell or transgenic plant can subsequently be collected from said host cell or transgenic plant by standard methods of extraction and/or chromatography (such as solvent extraction, solid phase extraction and reversed phase chromatography). In such a method for producing a glycoside, the present disclosure may indicate that during said culturing or growing a host cell or transgenic plant a certain compound or substrate (such as the aglycone component) used for formation of the glycoside "is present in said host cell or transgenic plant". This means that the compound or substrate is either produced by said host cell or transgenic plant, such that it is present in said host cell/in the cells of said transgenic plant, or that it is added to the host cell or transgenic plant in such a manner that it is taken up by the host cell or transgenic plant and enters into the host cell/cells of the transgenic plant. This may for example, be achieved by including the compound or substrate to the culture medium used for culturing the host cells (for example the growth medium used for culturing *E. coli* cells) or, in the case of a transgenic plant, by adding the compound or substrate to the water used for watering the plant (for example, an aqueous solution containing the compound/substrate or an aqueous solution with a low content of ethanol containing the compound/substrate may be added to the culture medium used for culturing the host cells or to the water used for watering the plant).

Further information on a biotechnological process to produce a flavor glycoside is set out in WO 2015/197844.

If the present application refers to "collecting" a certain glycoside, glycose ester or protein from a host cell or transgenic plant, this is meant to designate that said glycoside, glycose ester or protein is separated and/or isolated from other components of said host cell or transgenic plant. This can be achieved by standard methods of extraction and chromatography known to a person of skill in the art (see e.g. Example 1 of WO 2015/197844, which is hereby incorporated by reference in its entirety).

At some instances, the present application refers to a glycosyl transferase being "capable of catalyzing" a certain reaction. For example, the present application may state that a glycosyl transferase is capable of catalyzing transfer of a sugar group from a sugar donor to a certain acceptor. This is meant to designate that under appropriate reaction conditions the rate at which the reaction product (in the example the adduct of the sugar group and the acceptor) is formed is at least 10-fold higher in the presence of said glycosyl transferase than the rate at which the reaction product is formed in a control experiment in the absence of said glycosyl transferase.

At some instances, the present application indicates that a certain glycosyl transferase "has a glucosyl transferase activity" for a substrate A that is "by at least a factor X higher" than the glucosyl transferase activity for a substrate B. This means that, if the $k_{cat}/K_M$ values (i.e. the specificity constants) of said glycosyl transferase for substrate A and B are measured under appropriate conditions and the $k_{cat}/K_M$ value obtained for the glycosyl transferase with substrate A is divided by the $k_{cat}/K_M$ value obtained for the glycosyl transferase with substrate B, the resulting value is X or greater than X.

Similarly, the present application may indicate that a certain glycosyl transferase G "has a glucosyl transferase activity" for a certain substrate A that is "by at least a factor X higher" than the glucosyl transferase activity of another glycosyl transferase H for substrate A. This means that, if the $k_{cat}/K_M$ values of glycosyl transferase G and of glycosyl transferase H for substrate A are measured under appropriate conditions and the $k_{cat}/K_M$ value obtained for glycosyl transferase G with substrate A is divided by the $k_{cat}/K_M$ value obtained for glycosyl transferase H with substrate A, the resulting value is X or greater than X.

The $k_{cat}/K_M$ value can be determined by standard procedures known to the person of skilled in the art. Preferably, recombinant glycosyl transferases are used for determining the $k_{cat}/K_M$ values.

Preferably, the following procedure is used:

The kinetic data are determined with increasing concentrations of the substrates from 1 μM to 500 μM and a fixed concentration of sugar precursor (for example an UDP-glucose concentration of 108 μM (100 μM unlabelled UDP-glucose and 8 μM UDP-[$^{14}$C] glucose), 833 μM (825 μM unlabelled UDP-glucose and 8 μM UDP-[$^{14}$C] glucose) or 512.5 μM (500 μM unlabelled UDP-glucose and 12.5 μM UDP-[$^{14}$C] glucose)). The total volume is 40 μL and 0.2 μg, 0.5 μg or 5 μg of purified protein is used. The measurements are performed under the following conditions: The assays are carried out at 30° C. for 1.5 h, 30 min or 10 min using a Tris-HCl buffer (100 mM, 10 mM 2-mercaptoethanol, pH 8.5 or pH 7.5). The amount of the purified enzyme and the incubation time can be adapted depending on the counting sensibility. The reaction is stopped by adding 1 μL 24% trichloroacetic acid and glucosides are extracted with 100 μL ethyl acetate. Radioactivity is determined by LSC.

To determine the kinetic data of a sugar precursor (e.g. UDP-glucose), the value of the substrate used (e.g. geraniol) is fixed (1.25 mM or 0.1 mM) and radiolabelled sugar precursor (e.g. UDP-[$^{14}$C] glucose) is mixed with non-radiolabelled sugar precursor (in the example UDP-glucose) to obtain concentrations ranging from 5 μM to 100 μM or 25 μM to 500 μM. The $K_M$- and $V_{max}$-values are calculated from Lineweaver-Burk plots, Hanes-Woolf plots and non-linear fitting of the experimental data.

At some instances, the present application indicates that a certain glycosyl transferase can be "expressed more efficiently as a recombinant protein in *E. coli* cells" than another glycosyl transferase. The efficiency of recombinant protein expression in *E. coli* can be compared as follows: Recombinant expression of the different glycosyl transferases is carried out in *E. coli* cells by standard methods known to the skilled person, preferably according to the methods described in Example 1 of WO 2015/197844, which is hereby incorporated by reference in its entirety. Whole-cell extracts from the *E. coli* cells are prepared and proteins in the whole-cell extract are compared after gel-electrophoresis and visualization by coomassie-staining.

As "host cell" transfected with the nucleic acid molecule as described above, the cell of a prokaryotic or eukaryotic organism may be used. As the prokaryotic organism, bacteria, for example, commonly used hosts such as bacteria belonging to genus *Escherichia* such as *Escherichia coli* can be used. Alternatively, a cell of a lower eukaryotic organism such as eukaryotic microorganisms including, for example, yeast (e.g. *Saccharomyces cerevisiae*) or fungi like *Aspergillus oryzae* and *Aspergillus niger* can be used. Animal cells or plant cells also can be used as a host. Examples of animal cells that can be used include cell lines of mouse, hamster, monkey, human, etc., as well as insect cells such as silkworm cells and adult silkworm per se.

Construction of a vector may be performed using a restriction enzyme, ligase etc. according to a standard method known in the art. An "expression vector" is a vector that allows expression of a protein encoded by the DNA sequence of the vector in a target cell. The transformation of a host with an (expression) vector can be performed according to standard methods.

At some instances, the present application refers to a host cell being "transfected". This refers to a situation where foreign DNA is introduced into a cell. A transfected host cell may be "stably transfected". This refers to the introduction and integration of foreign DNA into the genome of the transfected cell. Alternatively, a transfected host cell may be "transiently transfected". This refers to the introduction of foreign DNA into a cell where the foreign DNA fails to integrate into the genome of the transfected cell.

As used herein, the term "transgenic plant" refers to a plant that has a heterologous gene integrated into its genome and that transmits said heterologous gene to its progeny. A "heterologous gene" is a gene that is not in its natural environment. For example, a heterologous gene includes a gene from one species introduced into another species. In some embodiments, a heterologous gene also includes a gene native to an organism that has been altered in some way (e.g., mutated, added in multiple copies, or linked to non-native regulatory sequences). Heterologous genes are distinguished from endogenous genes in that the heterologous gene sequences are typically joined to DNA sequences that are not found naturally associated with the gene sequences in the chromosome or are associated with portions of the chromosome not found in nature (e.g., genes expressed in loci where the gene is not normally expressed).

A "protein having glycosyl transferase activity" is a protein that is capable of catalyzing a glycosylation reaction in which the sugar group of a sugar donor is transferred to an acceptor molecule. A protein having glycosyl transferase activity can be obtained by culturing, cultivating or growing a host cell or organism that expresses such a protein (for example a host cell transformed with a vector as described in the above embodiments), and then by recovering and/or purifying the protein from the host cell, host organism or culture medium according to standard methods, such as filtration, centrifugation, cell disruption, gel filtration chromatography, ion exchange chromatography and the like. A "recombinantly expressed" glycosyl transferase is a glycosyl transferase protein that has been expressed from a recombinant DNA molecule, i.e. from a DNA molecule formed by laboratory methods of genetic engineering (such as molecular cloning) to bring together genetic material from multiple sources, creating a DNA sequence that would not be found naturally in a biological organism. Typically, a recombinantly expressed glycosyl transferase is expressed by heterologous expression (i.e. in a host organism which is different from the organism from which said glycosyl transferase is originally derived), such as by expression in e.g. *E. coli, Saccharomyces cerevisiae, Pichia pastoris* or insect cells, preferably in *E. coli*. Preferably, said recombinantly expressed glycosyl transferase is expressed by heterologous expression. Preferably, said recombinantly expressed glycosyl transferase is isolated after expression from other proteins of the host organism by methods of protein purification.

The term "reaction product composition", as used herein, refers to a composition obtained from a method for forming/producing said reaction product upon completion of the reaction step in which said reaction product is actually formed, wherein said composition is not subjected to any further steps of purifying or separating the components of the reaction mixture obtained after said reaction step in which said reaction product is actually formed. If used in the context of a method to produce a product in a host cell or transgenic plant, the term "reaction product composition" refers to the culture supernatant, host cell extract or transgenic plant extract in which said product is harvested from said host cell or transgenic plant. It has been found that WGT14 and VvGT15 have glucosyl transferase activities ($k_{cat}/K_M$) for the substrates geraniol, nerol and citronellol that are higher by a factor of 2.6 to 44 compared to known terpene glycosyl transferases, such as UGT85B1 of *Sorghum bicolor*. Moreover, it has been found that the glycosyl transferases VvGT14 and VvGT15 are expressed more efficiently than other known terpene glycosyl transferases as recombinant proteins in *E. coli* cells or other host cells. Moreover, it has been found that the glycosyl transferase VvGT14 is capable of catalyzing glucosylation of furaneol, whereas plant glycosyl transferases that are capable of catalyzing glucosylation of furaneol are otherwise not known.

For example, the methods described in Example 1 of WO 2015/197844, the entirety of which is hereby incorporated, can be used to produce the flavor glycoside as described herein.

It has been found that a flavor glycoside obtained from a biotechnological process as described hereinabove may comprise fewer impurities than a flavor glycoside obtained using chemical or synthetic methods. For example, a flavor glycoside prepared using chemical methods may typically contain impurities from e.g. the catalyst used during the synthesis, such as metal impurities. The flavor glycoside obtained from a biotechnological process may comprise less than 0.01 wt % of chemical impurities, such as less than 0.001 wt % of chemical impurities, such as less than 0.0001 wt % of chemical impurities. The flavor glycoside obtained from a biotechnological process may be entirely free from chemical impurities, such as entirely free from metallic impurities.

Characteristics of Flavor Glycoside

The identity of the sugar molecule that forms the backbone of the flavor glycoside may vary and may be any suitable saccharide. As the skilled person will appreciate, any saccharide in which the anomeric carbon is free (i.e. the anomeric carbon is not already bound with another molecule) will be suitable for forming a glycosidic bond. In some embodiments, the sugar is a monosaccharide or disaccharide. In some embodiments, the sugar is a monosaccharide; the monosaccharide may be a pentose or a hexose. In some embodiments, the sugar is a pentose. In some embodiments, the sugar is a pentose selected from the group consisting of ribose, deoxy-ribose, xylose and arabinose. In some embodiments, the sugar is a hexose. In some embodiments, the sugar is a hexose selected from the group consisting of glucose, fructose and galactose.

In some embodiments, the sugar is a diglycoside. As used herein, the term diglycoside refers to a compound having two glycoside groups; i.e. a sugar which can form two glycosidic bonds with one or two flavoring agents. In some embodiments, the sugar is a diglycoside selected from the group consisting of alpha-L-arabinofuranose, alpha-L-rhamnopyranose, beta-D-glucopyranose, beta-D-apiofuranose and beta-D-xylopyranose.

In some embodiments, the sugar is glucose and the flavor glycoside is a flavor glucoside. In some embodiments, the sugar is fructose.

As used herein, the term "flavoring agent" (or "flavor" or "flavorant") refers to materials, which, where local regulations permit, may be used to create a desired taste, aroma or other somatosensorial sensation in a product for adult consumers. Examples of sensory characteristics that can be modified by the flavoring agent include taste, mouthfeel, moistness, coolness/heat, and/or fragrance/aroma. Flavoring agents may be natural or synthetic, and the character of the flavors imparted thereby may be described, without limitation, as fresh, sweet, herbal, confectionary, floral, fruity, or spicy.

The flavoring agent bound via a glycosidic bond to the sugar molecule in the flavor glycoside may therefore vary widely. As the skilled person will appreciate, any flavoring agent having a hydroxyl group or amino group may be a suitable flavoring agent for forming a flavor glycoside. Notably as flavor glycosides have different solubility characteristics from the flavoring agent therein; it may be possible to include flavors which are generally not used in consumables for aerosol provision systems (e.g. formulations for e-cigarettes).

When the consumable of the present disclosure includes greater than 15. wt % water and particularly when the consumable includes greater than 50 wt. % water such that it can be considered a "high" water content consumable, the formation of the flavoring agent into a flavor glycoside allows the use of flavoring agents with low polarity which would otherwise not be feasible for use because of their low water solubility. Examples of flavoring agents which fall in this category include geraniol, nerol, citronellol, linalool, alpha-terpineol, perillyl alcohol, myrtenol and 1-octen-3-ol. Hence the present disclosure includes the use of a flavor glycoside to increase the water solubility of a flavoring agent in a consumable for an aerosol provision system.

It should also be possible to define a flavor profile for the user of the consumable with, for instance, defined flavor zones, and/or modify the strength/intensity, consistency and/or time period of flavor delivery. These aspects of the present disclosure are discussed in more detail below.

The flavoring agent may be selected from the group consisting of naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavoring agent comprises menthol, spearmint and/or peppermint. In some embodiments, the flavoring agent comprises flavor components of cucumber, blueberry, citrus fruits and/or redberry. In some embodiments, the flavoring agent comprises eugenol. In some embodiments, the flavoring agent comprises flavor components extracted from tobacco. In some embodiments, the flavoring agent comprises flavor components extracted from *cannabis*.

In some embodiments, the flavoring agent may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

In some embodiments, the flavoring agent is lipophilic. Without wishing to be bound by theory, formulation of a lipophilic flavoring agent as an emulsion may enhance the stability of the flavoring agent (e.g., toward oxidation or evaporation). In some embodiments, the flavoring agent is susceptible to oxidation, meaning exposure to air results in the degradation of components in the flavoring agent due to chemical changes. Examples of functional groups, which may be present in flavoring agent components exhibiting susceptibility to oxidation, include, but are not limited to, alkenes, aldehydes, and/or ketones. In some embodiments, the flavoring agent comprises a citrus oil. Citrus oils contain, for example, terpene components, which may be susceptible to oxidation, evaporation, or both and, thus, may particularly benefit from inclusion within a product in the form of an emulsion as provided herein.

In some embodiments, the flavoring agent may comprise a terpene. In some embodiments, the flavoring agent may comprise a monoterpene and/or a diterpene and/or a sesquiterpene. In some embodiments, the flavoring agent may comprise a monoterpene.

A "terpene", as used herein, is a hydrocarbon having a carbon skeleton formally derived by combination of several isoprene units. The term includes hydrocarbons having a carbon skeleton formally derived by combination of several isoprene units covalently linked to at least one hydroxy group, preferably covalently linked to one hydroxy group and/or covalently linked to at least one carboxyl group, preferably covalently linked to one carboxyl group. In some embodiments, the term "terpene" also includes hydrocarbons having a carbon skeleton formally derived by combination of several isoprene units in which up to three, preferably up to two, more preferably one, methyl groups have been moved or removed. As used herein, a "hydroxy-containing terpene" is a terpene that comprises one or more, preferably one, hydroxy group.

The term "terpene glycoside" refers to a glycoside the aglycone component of which is a terpene. The term "monoterpene glycoside" refers to a glycoside the aglycone component of which is a monoterpene (formally comprising two isoprene units, such as geraniol, citronellol or linalool). The term "sesquiterpene glycoside" refers to a glycoside the aglycone component of which is a terpene formally comprising three isoprene units (such as farnesol). The term "diterpene glycoside" refers to a glycoside the aglycone component of which is a diterpene (formally comprising four isoprene units, such as steviol).

In some embodiments, the terpene is a terpene derivable from a phytocannabinoid producing plant, such as a plant from the stain of the *Cannabis sativa* species, such as hemp. Suitable terpenes in this regard include so-called "C10" terpenes, which are those terpenes comprising 10 carbon atoms, and so-called "C15" terpenes, which are those terpenes comprising 15 carbon atoms. In some embodiments, the consumable comprises more than one terpene. For example, the consumable may comprise one, two, three, four, five, six, seven, eight, nine, ten or more terpenes as defined herein. In some embodiments, the terpene is selected from pinene (alpha and beta), geraniol, linalool, limonene, carvone, eucalyptol, menthone, iso-menthone, piperitone, myrcene, beta-bourbonene, germacrene, thymol, citral, eugenol, and mixtures thereof.

In some embodiments, the flavoring agent is selected from the group consisting of terpenes, aliphatic alcohols, aromatic alcohols, pyrones, lactones, or phenylpropanoids, and combinations thereof. In some embodiments, the flavoring agent is or comprises a terpene.

In some embodiments, the flavoring agent is selected from the group consisting of geraniol, citronellol, nerol, maltol, ethylmaltol, fenchol, homofuraneol, furaneol, norfuraneol, 1-octen-3-ol, borneol, linalool, farnesol, hydroxycitronellol, 3,7-dimethyloctanol, myrcenol, lavandulol, nerolidol, terpineol, alpha-terpineol, menthol, thymol, carvacrol, myrtenol, carveol, santalol, piperitol, perillyl alcohol, patchouli alcohol, hexanol, 1-hexanol, 3-cis-hexanol, cis-3-hexen-1-ol, phenylethanol, eugenol, sesamol, sotolone, maple furanone, methyl anthranilate, guaiacol, raspberry ketone, 2-methoxy-4-vinylphenol, 4-ethylguaiacol, benzylalcohol, homofuraneol, vanillin, ethylvanillin, and combinations thereof. In some embodiments, the flavoring agent is selected from the group consisting of geraniol, citronellol, nerol, maltol, ethylmaltol, fenchol, homofuraneol, furaneol, norfuraneol, 1-octen-3-ol, borneol, linalool, farnesol, hydroxycitronellol, 3,7-dimethyloctanol, myrcenol, lavandulol, nerolidol, terpineol, alpha-terpineol, menthol, thymol, carvacrol, myrtenol, carveol, santalol, piperitol, perillyl alcohol, patchouli alcohol, hexanol, 1-hexanol, 3-cis-hexanol, cis-3-hexen-1-ol, phenylethanol, eugenol, sesamol, sotolone, maple furanone, methyl anthranilate, guaiacol, raspberry ketone, 2-methoxy-4-vinylphenol, 4-ethylguaiacol, benzylalcohol, homofuraneol, vanillin, ethylvanillin, and combinations thereof.

In some embodiments, the flavoring agent is or comprises raspberry ketone. In some embodiments, the flavoring agent is or comprises eugenol. In some embodiments, the flavoring agent is or comprises thymol. In some embodiments, the flavoring agent is or comprises geraniol. In some embodiments, the flavoring agent is selected from the group consisting of geraniol, (R-) linalool, (R- and/or S-)citronellol, nerol, 8-hydroxylinalool and farnesol.

In some embodiments, the flavoring agent is or comprises vanillin. In some embodiments, the flavoring agent is or comprises ethylvanillin. In some embodiments, the flavoring agent is not vanillin or ethylvanillin.

In some embodiments, the flavor glycoside is selected from the group consisting of 3-methoxystyrene-4-yl-O-β-D-glucopyranoside, 4-ethyl-2-methoxyphenyl-O-β-D-glucopyranoside, phenylmethyl-O-β-D-glucopyranoside, endo-(1S)-1,7,7-trimethylbicyclo[2.2.1]heptan-2-yl-O-β-D-glucopyranoside, 2-methyl-5-(1-methylethyl)phenyl-O-β-D-glucopyranoside, 3,7-dimethyl-6-octen-1-yl-O-β-D-glucopyranoside, 2-methoxy-4-(2-propen-1-yl)phenyl-O-β-D-glucopyranoside, 2-ethyl-4H-pyran-4-one-3-O-β-D-glucopyranoside, 3,7,11-trimethyl-2,6,10-dodecatrien-1-yl-O-β-D-glucopyranoside, 1,3,3-trimethyl-bicyclo[2.2.1] heptan-2-yl-O-β-D-glucopyranoside, 2,5-dimethyl-3(2H)-furanone-4-O-β-D-glucopyranoside, (2E)-3,7-dimethyl-2,6-octadien-1-yl-O-β-D-glucopyranoside, (2/5)-ethyl-5 (or 2)-methyl-3(2H)-furanone-4-O-β-D-glucopyranoside, hex-1-yl-O-β-D-glucopyranoside, 4-[4'-hydroxy phenyl]-butan-2-one-4'-O-β-D-glucopyranoside, (3Z)-3-hexen-1-yl-O-β-D-glucopyranoside, 1-ethenyl-1,5-dimethyl-4-hexen-1-yl-O-β-D-glucopyranoside, methyl-2-aminobenzoate-N-β-D-glucopyranoside, (1R, 2S, 5R)-5-methyl-2-(1-methylethyl) cyclohexyl-O-β-D-glucopyranoside, 5-ethyl-3-hydroxy-4-methyl-2(5H)-furanone-3-O-β-D-glucopyranoside, 2-methyl-4H-pyran-4-one-3-O-β-D-glucopyranoside, 6,6-dimethylbicyclo(3.1.1)hept-2-ene-2-methyl-O-β-D-glucopyranoside, 5-methyl-3(2H)-furanone-4-O-β-D-glucopyranoside, (2Z)-3,7-dimethyl-2,6-octadien-1-yl-O-β-D-glucopyranoside, 1-octen-3-yl-O-β-D-glucopyranoside, p-mentha-1,8-dien-7-yl-O-β-D-glucopyranoside, 2-phenyleth-1-yl-O-β-D-glucopyranoside, 3,4-(methylenedioxy) phenol, 5-Benzodioxolyl-O-β-D-glucopyranoside, 4,5-dimethylfuran-2(5H)-one-3-O-β-D-glucopyranoside, (S)-2-(4-methyl-3-cyclohexenyl)-2-propanyl-O-β-D-glucopyranoside, 5-methyl-2-(1-methylethyl)phenyl-O-β-D-glucopyranoside, 3-methoxy-benzyl alcohol-4-O-β-D-glucopyranoside, and combinations thereof.

In some embodiments, the flavor glycoside is selected from the group consisting of 3-methoxystyrene-4-yl-O-β-D-glucopyranoside, 4-ethyl-2-methoxyphenyl-0-β-D-glucopyranoside, phenylmethyl-O-β-D-glucopyranoside, endo-(1S)-1,7,7-trimethylbicyclo[2.2.1]heptan-2-yl-O-β-D-glucopyranoside, 2-methyl-5-(1-methylethyl)phenyl-O-β-D-glucopyranoside, 3,7-dimethyl-6-octen-1-yl-O-β-D-glucopyranoside, 2-methoxy-4-(2-propen-1-yl)phenyl-O-β-D-glucopyranoside, 2-ethyl-4H-pyran-4-one-3-O-β-D-glucopyranoside, 3,7,11-trimethyl-2,6,10-dodecatrien-1-yl-O-β-D-glucopyranoside, 1,3,3-trimethyl-bicyclo[2.2.1] heptan-2-yl-O-β-D-glucopyranoside, 2,5-dimethyl-3(2H)-furanone-4-O-β-D-glucopyranoside, (2E)-3,7-dimethyl-2,6-octadien-1-yl-O-β-D-glucopyranoside, (2/5)-ethyl-5 (or 2)-methyl-3(2H)-furanone-4-O-β-D-glucopyranoside, hex-1-yl-O-β-D-glucopyranoside, 4-[4'-hydroxy phenyl]-butan-2-one-4'-O-β-D-glucopyranoside, (3Z)-3-hexen-1-yl-O-β-D-glucopyranoside, 1-ethenyl-1,5-dimethyl-4-hexen-1-yl-O-β-D-glucopyranoside, methyl-2-aminobenzoate-N-β-D-glucopyranoside, (1R, 2S, 5R)-5-methyl-2-(1-methylethyl) cyclohexyl-O-β-D-glucopyranoside, 5-ethyl-3-hydroxy-4-methyl-2(5H)-furanone-3-O-β-D-glucopyranoside, 2-methyl-4H-pyran-4-one-3-O-β-D-glucopyranoside, 6,6-dimethylbicyclo(3.1.1)hept-2-ene-2-methyl-O-β-D-glucopyranoside, 5-methyl-3(2H)-furanone-4-O-β-D-glucopyranoside, (2Z)-3,7-dimethyl-2,6-octadien-1-yl-O-β-D-glucopyranoside, 1-octen-3-yl-O-β-D-glucopyranoside, p-mentha-1,8-dien-7-yl-O-β-D-glucopyranoside, 2-phenyleth-1-yl-O-β-D-glucopyranoside, 3,4-(methylenedioxy) phenol, 5-Benzodioxolyl-O-β-D-glucopyranoside, 4,5-dimethylfuran-2(5H)-one-3-O-β-D-glucopyranoside, (S)-2-(4-methyl-3-cyclohexenyl)-2-propanyl-O-β-D-glucopyranoside, 5-methyl-2-(1-methylethyl)phenyl-O-β-D-glucopyranoside, and combinations thereof.

In some embodiments, the flavor glycoside is selected from the group consisting of geranyl β-D-glucoside, (R-) linaloyl β-D-glucoside, (R- and/or S-)citronellyl β-D-glucoside, neryl β-D-glucoside, 8-hydroxylinaloyl glucoside and farnesyl glucoside. In some embodiments, the flavor glycoside is selected from the group consisting of geranyl β-D-glucoside and/or (R- and/or S-)citronellyl β-D-glucoside. In some embodiments, the flavor glycoside is geranyl R-D-glucoside.

In some embodiments, the flavor glycoside is octanyl glycoside, such as octanyl glucoside. In some embodiments, the flavor glycoside is furanyl glycoside, such as furanyl glucoside. In some embodiments, the flavor glycoside is hexanyl glycoside, such as hexanyl glucoside.

In some embodiments, the flavor glycoside is not or does not comprise 3-methoxy-benzyl alcohol-4-O-β-D-glucopyranoside.

In some embodiments, the flavor glycoside is present in an amount of from about 0.001% to about 20% by weight of the consumable. In some embodiments, the flavor glycoside is present in an amount of from about 0.01% to about 15% by weight of the consumable, such as from about 0.1% to about 10% by weight of the consumable, such as from about 0.5% to about 7.5% by weight of the consumable, such as from about 1% to about 5% by weight of the consumable. In some embodiments, the flavor glycoside is present in an amount of from about 0.1% to about 5% by weight of the consumable, such as from about 0.25% to about 4.5% by weight of the consumable, such as from about 0.5% to about 4% by weight of the consumable, such as from about 0.75% to about 3.5% by weight of the consumable, such as from about 1% to about 3% by weight of the consumable, such as from about 1.5% to about 2.5% by weight of the consumable. In some embodiments, the flavor glycoside is present in an amount of from about 0.001% to about 2% by weight of the consumable, such as from about 0.01% to about 1.5% by weight of the consumable, such as from about 0.05% to about 1% by weight of the consumable, such as from about 0.1% to about 0.75% by weight of the consumable, such as from about 0.1% to about 0.5% by weight of the consumable.

In some embodiments, the flavor glycoside is present in an amount of from about 0.001% to about 10% by weight of the consumable. In some embodiments, the flavor glycoside is present in an amount of from about 0.01% to about 10% by weight of the consumable, such as from about 0.1% to about 10% by weight of the consumable, such as from about 0.5% to about 7.5% by weight of the consumable, such as from about 1% to about 6% by weight of the consumable. In some embodiments, the flavor glycoside is present in an amount of from about 0.1% to about 6% by weight of the consumable.

The inclusion of a flavoring agent in the form of a flavor glycoside may provide improved levels of control over the release kinetics and release profile of the flavoring agent when the consumable is used in an aerosol provision system. In this regard, it has been found that the inclusion of a flavoring agent in the form of a flavor glycoside may provide slower, more prolonged and/or more intense release of the flavoring agent during use. Such release characteristics may allow a user to experience the sensorial benefits of the flavoring agent over an extended period of time, typically measured by the number of puffs of the aerosol provision system containing the consumable and/or a certain period of time. This may mean that there is a less pronounced reduction in flavor perceived by the user even after the consumable has been subject to use in the aerosol provision system for an extended period of time.

The inclusion of a flavoring agent in the form of a flavor glycoside may enhance the sensorial experience of the flavoring agent by the user. In this regard, it has been found that the flavor glycoside can enhance aroma perception of the flavoring agent by the user on inhalation of the aerosol generated from the consumable. Without wishing to be bound by any one theory, it is believed that when the aerosol provision system has an operating temperature below 100° C. (as is often the case for e-cigarettes) the flavor glycoside is aerosolized in its uncleaved form and delivered to the oral cavity of the user where the salivary enzymes (e.g. glucosidase) cause cleavage of the glycosidic bond thereby releasing the flavoring agent into the user's oral cavity. Consequently the flavor perception may be increased compared to the use of the flavoring agent not in the form of a flavor glycoside. In this respect the use of an additional flavoring agent with the flavor glycoside can be advantageous since it can be used to change the flavor profile (e.g. with different flavor zones) or prolong the flavor profile, e.g. inhalation of the additional flavoring agent occurs before the flavoring agent is cleaved from its form as a flavor glycoside in the user's oral cavity.

Of course when the aerosol provision system operates at a temperature above 100° C., the same advantage may be realized but via cleavage of the glycosidic bond due to heat and inhalation of both the flavoring agent and additional flavoring agent, the latter being inhaled prior to the former because of the need for cleavage to occur before flavor delivery.

In some embodiments, no more than 50% by weight of the flavoring agent is released from the flavor glycoside within about 10 puffs of the aerosol provision system comprising the consumable of the present disclosure. This percentage by weight is based on the total weight of all flavoring agent included in the flavor glycoside. By "no more than X % . . . is released within about Y puffs" is meant that, after Y puffs of the aerosol provision system by the user, the amount of flavoring agent released from the flavor glycoside is no greater than X % by weight. As used herein, the term "released" in the context of the flavoring agent being released from the flavor glycoside refers to the enzymatic cleavage of the flavoring agent from the sugar molecule.

The amount of flavoring agent released from or enzymatically cleaved from the sugar molecule in the flavor glycoside can be measured by any method known to a person skilled in the art. For example, the amount of flavoring agent released during exhalation may be measured online via selected ion flow tube mass spectrometry (SIFT-MS).

In some embodiments, no more than 40% by weight of the flavoring agent, such as no more than 35% by weight of the flavoring agent, such as no more than 30% by weight of the flavoring agent, such as no more than 25% by weight of the flavoring agent, such as no more than 20% by weight of the flavoring agent, such as no more than 15% by weight of the flavoring agent, such as no more than 10% by weight of the flavoring agent, such as no more than 5% by weight of the flavoring agent, such as no more than 1% of the flavoring agent is released from the flavor glycoside within about 10 puffs of the aerosol provision system. In some embodiments, no more than 10% by weight of the flavoring agent is released from the flavor glycoside within about 10 puffs of the aerosol provision system.

In some embodiments, no more than 50% by weight of the flavoring agent is released from the flavor glycoside within about 50 puffs of the aerosol provision system. For example, no more than 40% by weight of the flavoring agent, such as no more than 30% by weight of the flavoring agent, such as no more than 25% by weight of the flavoring agent, such as no more than 20% by weight of the flavoring agent is released from the flavor glycoside within about puffs of the aerosol provision system.

Put another way, in some embodiments, no more than 50% by weight of the flavoring agent is released from the flavor glycoside within about 5 minutes of the user inhaling on an aerosol provision system comprising the consumable of the present disclosure. This percentage by weight is based on the total weight of all flavoring agent included in the flavor glycoside. By "no more than X % . . . is released within about Y minutes" is meant that, after Y minutes of the user inhaling on the device, the amount of flavoring agent released from the flavor glycoside is no greater than X % by weight. As used herein, the term "released" in the context of the flavoring agent being released from the flavor glycoside refers to the enzymatic cleavage of the flavoring agent from the sugar molecule. As noted above, it has been found that the use of a flavor glycoside in the consumable may prolong the delivery of flavor (from the flavoring agent) to the user during use.

In some embodiments, no more than about 60% by weight of the flavoring agent, such as no more than about 50% by weight of the flavoring agent, such as no more than about 40% by weight of the flavoring agent, such as no more than about 30% by weight of the flavoring agent, such as no more than about 20% by weight of the flavoring agent, such as no more than about 15% by weight of the flavoring agent, such as no more than about 10% by weight of the flavoring agent, such as no more than about 5% by weight of the flavoring agent, is released from the flavor glycoside within about 5 minutes of the user inhaling on an aerosol provision system comprising the consumable of the present disclosure. In some embodiments, no more than about 45% by weight of the flavoring agent is released from the flavor glycoside within about 5 minutes of the user inhaling on an aerosol provision system comprising the consumable of the present disclosure.

In some embodiments, no more than about 60% by weight of the flavoring agent is released from the flavor glycoside within about 10 minutes of the user inhaling on an aerosol provision system comprising the consumable of the present disclosure. For example, no more than about 40% by weight of the flavoring agent, such as no more than about 30% by weight of the flavoring agent, such as no more than about 25% by weight of the flavoring agent, such as no more than about 20% by weight of the flavoring agent, such as no more than about 15% by weight of the flavoring agent, such as no more than about 10% by weight of the flavoring agent is released from the flavor glycoside within about 10 minutes of the user inhaling on an aerosol provision system comprising the consumable of the present disclosure.

In some embodiments, no more than about 70% by weight of the flavoring agent is released from the flavor glycoside within about 15 minutes of the user inhaling on an aerosol provision system comprising the consumable of the present disclosure. For example, no more than about 60% by weight of the flavoring agent, such as no more than about 50% by weight of the flavoring agent, such as no more than about 40% by weight of the flavoring agent, such as no more than about 30% by weight of the flavoring agent, such as no more than about 25% by weight of the flavoring agent, such as no more than about 20% by weight of the flavoring agent, such as no more than about 15% by weight of the flavoring agent, such as no more than about 10% by weight of the flavoring agent, such as no more than about 5% by weight of the flavoring agent is released from the flavor glycoside within about 15 minutes of the user inhaling on an aerosol provision system comprising the consumable of the present disclosure. In some embodiments, no more than about 60% by weight of the flavoring agent is released from the flavor glycoside within about 15 minutes of the user inhaling on an aerosol provision system comprising the consumable of the present disclosure.

In some embodiments, no more than about 90% by weight of the flavoring agent is released from the flavor glycoside within about 20 minutes of the user inhaling on an aerosol provision system comprising the consumable of the present disclosure. In some embodiments, no more than about 80% by weight of the flavoring agent is released from the flavor glycoside within about 20 minutes of the user inhaling on an aerosol provision system comprising the consumable of the present disclosure. In some embodiments, no more than about 70% by weight of the flavoring agent is released from the flavor glycoside within about 20 minutes of the user inhaling on an aerosol provision system comprising the consumable of the present disclosure. For example, no more than about 60% by weight of the flavoring agent, such as no more than about 50% by weight of the flavoring agent, such as no more than about 40% by weight of the flavoring agent, such as no more than about 30% by weight of the flavoring agent, such as no more than about 25% by weight of the flavoring agent, such as no more than about 20% by weight of the flavoring agent, such as no more than about 15% by weight of the flavoring agent, such as no more than about 10% by weight of the flavoring agent is released from the flavor glycoside within about 20 minutes of the user inhaling on an aerosol provision system comprising the consumable of the present disclosure.

In some embodiments, no more than about 25% by weight of the flavoring agent is released from the flavor glycoside within about 5 minutes of the user inhaling on an aerosol provision system comprising the consumable of the present disclosure.

In some embodiments, no more than about 40% by weight of the flavoring agent is released from the flavor glycoside within about 10 minutes of the user inhaling on an aerosol provision system comprising the consumable of the present disclosure.

In some embodiments, the flavor from the flavoring agent is delivered to the user for a period of at least about 10 minutes when the user inhales on an aerosol provision system comprising the consumable of the present disclosure. In some embodiments, the flavor from the flavoring agent is delivered to the user for a period of at least about 15 minutes, such as at least about 15 minutes, such as at least about 20 minutes, such as at least about 25 minutes, such as at least about 30 minutes when the user inhales on an aerosol provision system comprising the consumable of the present disclosure. In some embodiments, the flavor from the flavoring agent is delivered to the user for a period of at least about 30 minutes when the user inhales on an aerosol provision system comprising the consumable of the present disclosure. It has therefore been found that the use of a flavor glycoside in the oral product may prolong the delivery of flavor (from the flavoring agent) to the user during use.

In addition to the enhancement and prolonging of flavor delivery, the formation of the flavoring agent as a flavor glycoside can increase and thereby improve the water solubility of the flavoring agent. Many flavoring agents are hydrophobic and therefore poorly soluble in water, e.g. at 25° C. the water solubility of vanillin alcohol is approximately 2 g/l. By forming the flavoring agent as a flavor glycoside, however, the water solubility of the flavoring agent is improved. As shown in the Examples below, vanillin alcohol in the form of a glucoside has a water solubility of 62 g/L, this is an increase of 32×. This means that the flavor glycosides can be used to broaden the spectrum of flavors available for use in water-based consumables, such as consumables of the present disclosure which may have greater than about 15 wt. % water, e.g. "high water content e-liquids" as discussed and defined herein.

In some embodiments of the present disclosure, water may be present in an amount of at least 16 wt. % based on the consumable. In some embodiments, water may be present in an amount of at least 20 wt. % based on the consumable. In some embodiments, water may be present in an amount of at least 25 wt. % based on the consumable. In some embodiments, water may be present in an amount of at least 30 wt. % based on the consumable. In some embodiments, water may be present in an amount of at least 35 wt. % based on the consumable. In some embodiments, water may be present in an amount of at least 40 wt. % based on the consumable. In some embodiments, water may be present in an amount of at least 45 wt. % based on the consumable. In some embodiments, water may be present in an amount of at least 50 wt. % based on the consumable.

In some embodiments of the present disclosure, water may be present in an amount of greater than 15 wt. % to less than 99 wt. % based on the consumable. In some embodiments, water may be present in an amount of at least 16 wt. % to less than 99 wt. % based on the consumable. In some embodiments, water may be present in an amount of at least 20 wt. % to less than 99 wt. % based on the consumable. In some embodiments, water may be present in an amount of at least 25 wt. % to less than 99 wt. % based on the consumable. In some embodiments, water may be present in an amount of at least 30 wt. % to less than 99 wt. % based on the consumable. In some embodiments, water may be present in an amount of at least 35 wt. % to less than 99 wt. % based on the consumable. In some embodiments, water may be present in an amount of at least 40 wt. % to less than 99 wt. % based on the consumable. In some embodiments, water may be present in an amount of at least 45 wt. % to less than 99 wt. % based on the consumable. In some embodiments, water may be present in an amount of at least 50 wt. % to less than 99 wt. % based on the consumable.

The consumable may be in the form of a solid, liquid or a gel. When the consumable is a solid, the term "water content" refers to the moisture content of the consumable prior to use in the aerosol provision system. The water content of the consumable when it is in solid or gel form may be have an upper limit of about 35 wt. %. The skilled person will appreciate that this upper limit can be combined with one or more of the above lower limits or be used as a stand-alone upper limit. For example, water may be present in an amount of less than about wt. % water when the consumable is a gel, such as less than about 25 wt. % water or less than about 20 wt. % water.

Exemplary aerosolisable formulations containing increasing levels of water are described in WO 2020/089634, WO 2020/089631, WO 2020/089637, WO 2020/089640, WO 2020/089641, WO 2020/089633, WO 2020/089635, WO 2020/089638, and WO 2020/089639, each of which are incorporated herein by reference. An exemplary gel formulation and solid (crystalline powder) is described in WO 2020/089636, incorporated herein by reference.

The use of water allows the replacement of some or all of the aerosol-former material described above, e.g. glycerol, propylene glycol, 1,3-propane diol and mixtures thereof. In some embodiments, the consumable comprises no greater than 80 wt. % of the aerosol-former material, e.g. no greater than 75 wt. % of the combined amount of propylene glycol, glycerol and 1,3-propane diol. In some embodiments, the consumable comprises no greater than 35 wt. % of each of the aerosol former materials included therein. In some embodiments of the present disclosure, the consumable comprises no greater than 80 wt. % of the aerosol-former material, no greater than 75 wt. %, no greater than 70 wt. %, no greater than 65 wt. %, no greater than 60 wt. %, no greater than 55 wt. % or no greater than 50 wt. %.

The consumable may comprise an emulsion that comprises a continuous phase and a dispersed phase. The flavor glycoside may be present in the consumable in the continuous or dispersed phase of such an emulsion. For example, the consumable may comprise an emulsion including an oil phase and an aqueous phase, wherein the flavor glycoside is present in the oil phase and/or the aqueous phase. In some embodiments, the flavor glycoside is present in the aqueous phase of such an emulsion. In some embodiments, the consumable comprises an oil-in-water emulsion and the flavor glycoside is present in the aqueous phase of the emulsion.

The emulsion may be any suitable emulsion for inclusion in a consumable, e.g. an e-liquid. The amount of the emulsion in the consumable may vary, and may be any suitable amount for forming a product suitable for use (and aerosolization) in an aerosol provision system as described herein.

The consumable may comprise one or more other components, several of these components are defined in the appended claims and/or discussed further below. In addition, the consumable may comprise one or more other components such as an aerosol-generating material storage area, an aerosol-generating material transfer component, an aerosol generation area, a housing, a wrapper, a mouthpiece, a filter and/or an aerosol-modifying agent. In various embodiments, the consumable may comprise an aerosol-generating material storage area and an aerosol generation area. The consumable may further comprise an aerosol-generating material transfer component and/or a housing.

The aerosol-generating storage area may be an area for receiving aerosolisable material. For example, the storage area may be a reservoir. In one embodiment, the aerosol-generating storage area may be separate from, or combined with, an aerosol generating area. The aerosol generating area may also be referred to as an aerosol generation chamber.

The consumable may also comprise an aerosol-generator, such as a heater, that emits heat to cause the aerosol-generating material to generate aerosol in use. The heater may, for example, comprise combustible material, a material heatable by electrical conduction, or a susceptor. In alternative embodiments, an aerosol-generator may be comprised in the aerosol provision system as discussed in more detail below, as a separate component to the consumable. The present disclosure is not limited to either arrangement in this respect.

In other embodiments the consumable is a composition or formulation comprising the components defined in the appended claims and discussed further below. For example, the consumable may be a composition comprising the flavor glycoside and aerosol generating material. This composition may be a liquid at 25° C.

Active Ingredient

In some embodiments, the consumable further comprises at least one active ingredient. The active ingredient may be any suitable active ingredient that causes a biological response in a human or animal. The active ingredient as used herein may be a physiologically active material, which is a material intended to achieve or enhance a physiological response. The active substance may for example be selected from nutraceuticals, nootropics, psycho-actives. The active substance may be naturally occurring or synthetically obtained. The active substance may comprise for example nicotine, caffeine, taurine, theine, vitamins such as B6 or B12 or C, melatonin, ginseng, theanine, gamma-aminobutyric acid (GABA), cannabinoids, or constituents, derivatives, or combinations thereof.

In some embodiments, the active ingredient is selected from a nicotine component, a botanical ingredient (e.g., lavender, peppermint, chamomile, basil, rosemary, ginger, ginseng, maca, and tisanes), a stimulant (e.g., caffeine or guarana), an amino acid (e.g., taurine, theanine, phenylalanine, tyrosine, GABA and tryptophan), a cannabinoid, and/or a pharmaceutical, nutraceutical, or medicinal ingredient (e.g., a vitamin, such as B6, B12, and C).

In some embodiments, the active ingredient comprises nicotine, wherein the nicotine is in addition to any nicotine present in a tobacco material if present (i.e. "additional nicotine"). The additional nicotine may be present in any suitable form of nicotine (e.g., free base or salt) for providing oral absorption of at least a portion of the nicotine present. Typically, the nicotine is selected from the group consisting of nicotine free base and a nicotine salt. In some embodiments, nicotine is in its free base form, which can be easily adsorbed in for example, a microcrystalline cellulose material to form a microcrystalline cellulose-nicotine carrier complex. See, for example, the discussion of nicotine in free base form in US Pat. Pub. No. 2004/0191322 to Hansson, which is incorporated herein by reference.

In some embodiments, at least a portion of the additional nicotine can be employed in the form of a salt. Salts of nicotine can be provided using the types of ingredients and techniques set forth in U.S. Pat. No. 2,033,909 to Cox et al. and Perfetti, Beitrage Tabakforschung Int., 12: 43-54 (1983), which are incorporated herein by reference. Further salts are disclosed in, for example, U.S. Pat. No. 9,738,622 to Dull et al., and US Pat. Pub. Nos. 2018/0230126 to Dull et al., 2016/0185750 to Dull et al., and 2018/0051002 to Dull et al., each of which is incorporated herein by reference. Additionally, salts of nicotine are available from sources such as Pfaltz and Bauer, Inc. and K&K Laboratories, Division of ICN Biochemicals, Inc.

In some embodiments, the additional nicotine is selected from the group consisting of nicotine free base, a nicotine salt such as hydrochloride, dihydrochloride, monotartrate, bitartrate, sulfate, salicylate, and nicotine zinc chloride.

In some embodiments, at least a portion of the additional nicotine can be in the form of a resin complex of nicotine, where nicotine is bound in an ion-exchange resin, such as nicotine polacrilex, which is nicotine bound to, for example, a polymethacrylic acid, such as Amberlite IRP64, Purolite C115HMR, or Doshion P551. See, for example, U.S. Pat. No. 3,901,248 to Lichtneckert et al., which is incorporated herein by reference. Another example is a nicotine-polyacrylic carbomer complex, such as with Carbopol 974P. In some embodiments, nicotine may be present in the form of a nicotine polyacrylic complex.

In some embodiments, the additional nicotine when present is in a concentration of at least about 0.001% by weight of the consumable, such as in a range from about 0.001% to about 10%. In some embodiments, the additional nicotine is present in a concentration from about to about 10% by weight, such as from about from about 0.1% to about 9%, such as from about 0.2% to about 8%, such as from about 0.3% to about 7%, such as from about to about 6%, such as from about 0.5% to about 5%, such as from about 0.6% to about 4%, such as from about 0.7% to about 3%, such as from about 0.8% to about 2%, or from about 0.9% to about 1%, calculated as the free base and based on the total weight of the consumable. In some embodiments, the nicotine component is present in a concentration from about 0.1% to about 3% by weight, such as from about from about 0.1% to about 2.5%, such as from about 0.1% to about 2.0%, such as from about 0.1% to about 1.5%, such as from about 0.1% to about 1% by weight, calculated as the free base and based on the total weight of the consumable.

It is noted that these above ranges also apply to each of the other additional active ingredients noted herein.

In some embodiments, the active ingredient comprises caffeine, melatonin or vitamin B12. In some embodiments, the active ingredient comprises caffeine.

In some embodiments, the active ingredient comprises a cannabinoid. The cannabinoid may be a derivative or extract of *cannabis*. Cannabinoids are a class of natural or synthetic chemical compounds which act on cannabinoid receptors (i.e., CB1 and CB2) in cells that repress neurotransmitter release in the brain. Cannabinoids are cyclic molecules exhibiting particular properties such as the ability to easily cross the blood-brain barrier. Cannabinoids may be naturally occurring (Phytocannabinoids) from plants such as *cannabis*, (endocannabinoids) from animals, or artificially manufactured (synthetic cannabinoids). *Cannabis* species express at least 85 different phytocannabinoids, and these may be divided into subclasses, including cannabigerols, cannabichromenes, cannabidiols, tetrahydrocannabinols, cannabinols and cannabinodiols, and other cannabinoids, such as cannabigerol (CBG), cannabichromene (CBC), cannabidiol (CBD), tetrahydrocannabinol (THC), cannabinol (CBN) and cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

In some embodiments, the cannabinoid is selected from the group consisting of cannabigerol (CBG), cannabichromene (CBC), cannabidiol (CBD), tetrahydrocannabinol (THC), cannabinol (CBN) and cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), tetrahydrocannabivarinic acid (THCV A), and mixtures thereof. In some embodiments, the cannabinoid comprises at least tetrahydrocannabinol (THC). In some embodiments, the cannabinoid is tetrahydrocannabinol (THC). In some embodiments, the cannabinoid comprises at least cannabidiol (CBD). In some embodiments, the cannabinoid is cannabidiol (CBD).

In some embodiments, the cannabinoid is cannabidiol (CBD) or a pharmaceutically acceptable salt thereof. In some embodiments, the cannabidiol is synthetic cannabidiol. In some embodiments, the cannabinoid is added to the consumable in the form of an isolate. In some embodiments, the cannabidiol is added to the consumable in the form of an isolate. An isolate is an extract from a plant, such as *cannabis*, where the active material of interest (in this case the cannabinoid, such as CBD) is present in a high degree of purity, for example greater than 95%, greater than 96%, greater than 97%, greater than 98%, or around 99% purity.

In some embodiments, the cannabinoid is an isolate of CBD in a high degree of purity, and the amount of any other cannabinoid in the consumable is no greater than about 1% by weight of the consumable such as no greater than about 0.5% by weight of the consumable, such as no greater than about 0.1% by weight of the consumable, such as no greater than about 0.01% by weight of the consumable.

The choice of cannabinoid and the particular percentages thereof which may be present within the disclosed consumable will vary depending upon the desired flavor, texture, and other characteristics of the consumable.

In some embodiments, the cannabinoid (such as cannabidiol) is present in the consumable in a concentration of at least about 0.001% by weight of the consumable, such as in a range from about 0.001% to about 20% by weight of the consumable. In some embodiments, the cannabinoid (such as cannabidiol) is present in the consumable in a concentration of from about 0.1% to about 15% by weight, based on the total weight of the consumable. In some embodiments, the cannabinoid (such as cannabidiol) is present in a concentration from about 1% to about 15% by weight, such as from about from about 5% to about 15% by weight, based on the total weight of the consumable. In some embodiments, the cannabinoid (such as cannabidiol) is present in the consumable in a concentration of from about 0.5% to about 10% by weight, such as from about 1% to about 7.5% by weight, such as from 1.5% to about 5% by weight, such as from about 1.5% to about 2.5% by weight, based on the total weight of the consumable.

As described hereinabove, the consumable may comprise an emulsion that comprises a continuous phase and a dispersed phase. In some embodiments, the emulsion comprises an aqueous phase and a lipophilic phase, wherein the at least one flavor glycoside is present in the aqueous phase and the at least one active ingredient is present in the lipophilic phase. In some embodiments, the consumable comprises an oil-in-water emulsion, wherein the at least one flavor glycoside is present in the aqueous phase and the at least one active ingredient is present in the oil phase.

Additives

In some embodiments, the consumable further comprises one or more additional flavoring agents. As used herein, the term "additional flavoring agent" refers to a flavoring agent that is included in addition to the flavoring agent in the flavor glycoside. The additional flavoring agent may be present in its standard form; i.e. without having been bound to a sugar molecule via a glycosidic bond. As such, the consumable may comprise a flavor glycoside in addition to a flavoring agent that is not part of a flavor glycoside.

In some embodiments, the additional flavoring agent is different from the flavoring agent in the flavor glycoside. For example, in embodiments in which the flavor glycoside comprises a raspberry ketone bound to a sugar molecule via a glycosidic bond, the additional flavoring agent may be any flavoring agent other than a raspberry ketone.

In some embodiments, the additional flavoring agent is the same as the flavoring agent in the flavor glycoside. For example, in embodiments in which the flavor glycoside comprises a raspberry ketone bound to a sugar molecule via a glycosidic bond, the additional flavoring agent may be a raspberry ketone.

In some embodiments, there may be two or more additional flavoring agents. The two or more additional flavoring agents may both be different from the flavoring agent in the flavor glycoside, or one of the additional flavoring agents may be the same as the flavoring agent in the flavor glycoside whilst the other(s) may be different from the flavoring agent in the flavor glycoside.

The additional flavoring agents may be selected from any of the flavoring agents described hereinabove in respect of suitable flavoring agents for the flavor glycoside. For conciseness, these are not repeated here, but the same disclosure as hereinabove equally applies for the one or more additional flavoring agents.

In some embodiments, the rate of release of the flavoring agent in the flavor glycoside is slower than the rate of release of the one or more additional flavoring agents, wherein the rate of release is measured as the rate at which a flavoring agent is released during use of the consumable in the aerosol provision system. For example, when a user inhales or puffs on an aerosol provision system comprising the consumable as defined herein, the user may experience the sensation (e.g. aroma and/or taste) of the additional flavoring agent before experiencing the sensation of the flavoring agent that is cleaved from the sugar molecule in the flavor glycoside.

In some embodiments, the one or more additional flavoring agents is released from the consumable during use prior to the release of the flavoring agent from the flavor glycoside.

For example, in some embodiments, the rate of release of the one or more additional flavoring agents may be from about 1.1 to about 20 times faster than the rate of release of the flavoring agent from the flavor glycoside, such as from about 1.2 to about 15 times faster, such as from about 1.3 to about 10 times faster, such as from about 1.4 to about 7.5 times faster, such as from about 1.5 to about 5 times faster. In some embodiments, the additional flavoring agent may be released and inhaled by the user (i.e. perceived by the user) within a period of from about 1 second to about 20 minutes, such as from about 5 seconds to about 15 minutes, such as from about 10 seconds to about 10 minutes, such as from about 30 seconds to about 5 minutes, as compared with the rate of release of the flavoring agent from the flavor glycoside which is as described hereinabove.

Where the additional flavoring agent(s) is different from the flavoring agent in the flavor glycoside, such distinction in the rates of the release of the flavoring agents may provide the user with a flavor profile that changes over a period of time; i.e. the flavor released from the consumable may change over a period of time as the flavoring agent in the flavor glycoside is released after the additional flavoring agent(s). Such a flavor profile may be described as having one or more flavor zones.

Where the additional flavoring agent(s) is the same as the flavoring agent in the flavor glycoside, such distinction in the rates of the release of the flavoring agents may further prolong the period of time for which the flavor is delivered to the user. For example, flavor may be delivered to the user rapidly (i.e. within a period of from about 1 second to about 10 minutes) from the additional flavoring agent(s), and then the flavoring agent from the flavor glycoside may subsequently be released to prolong the delivery of the flavor to the user. In some embodiments, the flavor is delivered to the user for at least about 75% of available puffs of the aerosol provision system, such as at least about 80% of available puffs, such as at least about 85% of available puffs, such as at least about 90% of available puffs, such as at least about 95% of available puffs, such as at least about 97% of available puffs.

The amount of any additional flavoring agent included in the consumable can vary. In some embodiments, the consumable comprises one or more additional flavoring agents in an amount of up to about 10% by weight, such as up to about 5% by weight, such as up to about 1% by weight of the consumable. In some embodiments, the consumable comprises one or more additional flavoring agents in an amount of from about 0.01% to about 10% by weight, such as from about 0.1% to about 5% by weight, such as from about 0.5% to about 1% by weight of the consumable.

Aerosol Provision System

The present disclosure provides an aerosol provision system comprising the consumable defined herein. The aerosol provision system can implemented as a combustible aerosol provision system, a non-combustible aerosol provision system or an aerosol-free delivery system. In more detail, these systems are as follows:

combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokeable material);

non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

In various embodiments of the present disclosure, the aerosol provision system is a non-combustible aerosol system. This is one where a constituent aerosol-generating material of the aerosol provision system (or component thereof) is not combusted or burned in order to facilitate delivery of at least one substance to a user. In some embodiments, the aerosol provision system is a non-combustible aerosol provision system, such as a powered non-combustible aerosol provision system. In some embodiments, the non-combustible aerosol provision system is an electronic cigarette, also known as a vaping device or electronic nicotine delivery system (END), although it is noted that the presence of nicotine in the aerosol-generating material is not a requirement. In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product; what is meant by "tobacco" is defined hereinabove.

Typically, the non-combustible aerosol provision system may comprise a non-combustible aerosol provision device and a consumable for use with the non-combustible aerosol provision device, the consumable being as defined herein.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate, which may be energized to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent. FIG. 1 is a highly schematic diagram (not to scale) of an example aerosol provision system, such as an e-cigarette 10, to which embodiments are applicable. The e-cigarette has a generally cylindrical shape, extending along a longitudinal axis indicated by a dashed line (although aspects of the present disclosure are applicable to e-cigarettes configured in other shapes and arrangements), and comprises two main components, namely an aerosol provision device 20 and an article 30.

The article 30 includes a store for aerosolisable material (source liquid) 38 containing a material (source liquid) from which an aerosol is to be generated. This material may correspond to the consumable according to the present disclosure or the consumable may be included in a separate compartment through which heated air passes through (not shown in FIG. 1). Alternatively the article 30 may correspond to the consumable according to the present disclosure. The article 30 in FIG. 1 further comprises an aerosol generating component (heating element or heater) 36 for heating aerosolisable material to generate the aerosol. A transport element or wicking element or wick 37 is provided to deliver aerosolisable material from the store 38 to the heating element 36. A part or parts of the wick 37 are in fluid communication with aerosolisable material in the store 38 and by a wicking or capillary action aerosolisable material is drawn along or through the wick 37 to a part or parts of the wick 37 which are in contact with the heater 36.

Vaporization of the aerosolisable material occurs at the interface between the wick 37 and the heater 36 by the provision of heat energy to the aerosolisable material to cause evaporation, thus generating the aerosol. The aerosolisable material, the wick 37 and the heater 36 may be collectively referred to as an aerosol or vapor source. The wick 37 and the heater 36 may be collectively referred to as a vaporizer or an atomizer 15. Typically, a single wick will be present, but it is envisaged that more than one wick could be present, for example, two, three, four or five wicks. The wick may be formed a sintered material. The sintered material may comprise sintered ceramic, sintered metal fibres/powders, or a combination of the two. The (or at least one of/all of the) sintered wick(s) may have deposited thereon/embedded therein an electrically resistive heater. Such a heater may be formed from heat conducting alloys such as NiCr alloys. Alternatively, the sintered material may have such electrical properties such that when a current is passed there through, it is heated. Thus, the aerosol-generating component and the wick may be considered to be integrated. In some embodiments, the aerosol-generating component and the wick are formed from the same material and form a single component. The article 30 further includes a mouthpiece 35 having an opening through which a user may inhale the aerosol generated by the vaporizer 15. The aerosol for inhalation may be described as an aerosol stream or inhalable airstream.

The aerosol delivery device 20 includes a power source (a re-chargeable cell or battery 14, referred to herein after as a battery) to provide power for the e-cigarette 10, and a controller (printed circuit board (PCB)) 28 and/or other electronics for generally controlling the e-cigarette 10. The aerosol delivery device can therefore also be considered as a battery section, or a control unit or section. During operation of the device, the controller will determine that a user has initiated a request for the generation of an aerosol. This could be done via a button on the device which sends a signal to the controller that the aerosol generator should be powered. Alternatively, a sensor located in or proximal to the airflow pathway could detect airflow through the airflow pathway and convey this detection to the controller. A sensor may also be present in addition to the presence of a button, as the sensor may be used to determine certain usage characteristics, such as airflow, timing of aerosol generation etc. For example, in use, when the heater 36 receives power from the battery 14, as controlled by the circuit board 28 possibly in response to pressure changes detected by an air pressure sensor (not shown), the heater 36 vaporizes aerosolisable material delivered by the wick 37 to generate the aerosol, and this aerosol stream is then inhaled by a user through the opening in the mouthpiece 35. The aerosol is carried from the aerosol source to the mouthpiece 35 along an air channel (not shown in FIG. 1) that connects the aerosol source to the mouthpiece opening as a user inhales on the mouthpiece.

In this particular example, the device 20 and article 30 are detachable from one another by separation in a direction parallel to the longitudinal axis, as shown in FIG. 1, but are joined together when the system 10 is in use by cooperating engagement elements 21, 31 (for example, a screw, magnetic or bayonet fitting) to provide mechanical and electrical connectivity between the device 20 and the article 30, in particular connecting the heater 36 to the battery 14. The battery may be charged as is known to one skilled in the art.

In some embodiments, the article comprises/forms a sealed container. For example, the sealed container may be hermetically sealed. The hermetically sealed container may comprise a blister pack with one or more hermetically sealed compartments for storage of one or more articles comprising the consumable described herein. As noted above, in various embodiments the present disclosure provides the use of a flavor glycoside to extend the shelf-life of a flavoring agent in a consumable for an aerosol provision system, wherein the flavor glycoside comprises a flavoring agent bound to a sugar via a glycosidic bond. In this respect it was found that the lower volatility of flavor glycosides compared to flavoring agents not bound to a sugar was beneficial at increasing the period of time for which a consumable could be stored before use.

Process

In accordance with some embodiments described herein, there is provided a process for preparing a consumable as described herein, the process comprising the steps of:

(a) providing aerosol-generating material and at least one flavor glycoside, wherein the flavor glycoside comprises a flavoring agent bound to a sugar via a glycosidic bond; and (b) contacting the aerosol-generating material and the at least one flavor glycoside to provide the consumable, wherein the consumable comprises greater than about 15 wt. % water.

The flavor glycoside may be as described hereinabove, and may be obtained using any of the methods described herein. In some embodiments, the process further comprises the step of obtaining the at least one flavor glycoside by using a biotechnological process. The biotechnological process may be as described in detail hereinabove.

In accordance with some embodiments described herein, there is provided a process for preparing a consumable as described herein, the process comprising the steps of:

(a) providing aerosol-generating material and at least one flavor glycoside, wherein the flavor glycoside comprises a flavoring agent bound to a sugar via a glycosidic bond and is obtained from a biotechnological process; and (b) contacting the aerosol-generating material and the at least one flavor glycoside to provide the consumable.

In some embodiments, the process further comprises the step of obtaining the at least one flavor glycoside by using a biotechnological process. The biotechnological process may be as described in detail hereinabove.

In some embodiments, step (b) comprises mixing the aerosol-generating material and the at least one flavor glycoside. In some embodiments, the at least one flavor glycoside is in solid form (e.g. in the form of a powder). The flavor glycoside may be mixed directly with the aerosol-generating material to provide the consumable. Mixing may take place at room temperature and under ambient conditions.

In some embodiments, the at least one flavor glycoside may be dissolved in a hydrophilic solvent (e.g. water and/or alcohol) prior to contacting the aerosol-generating material. For example, the at least one flavor glycoside may be dissolved in water or ethanol before being mixed with the aerosol-generating material. The process may, in such embodiments, comprise the step of drying the product so as to remove the solvent. For example, the product may be dried via heating, freeze-drying, spray-drying, or simply leaving the product at room temperature for a certain period of time. Preferably, the drying step comprises leaving the product at room temperature for a period of 1 hour to 48 hours to remove the solvent.

Use

According to some embodiments described herein, there is provided the use of a flavor glycoside to prolong flavor of a consumable in an aerosol provision system, wherein the flavor glycoside comprises a flavoring agent bound to a sugar via a glycosidic bond. As discussed above, it has been found that the use of a flavor glycoside in the consumable may prolong the delivery of flavor (from the flavoring agent) to the user during use.

According to some embodiments described herein, there is provided the use of a flavor glycoside to change the flavor released from a consumable over a period of time, wherein the consumable comprises a flavor glycoside and one or more additional flavoring agents, wherein the flavor glycoside comprises a flavoring agent bound to a sugar via a glycosidic bond and wherein the one or more additional flavoring agents is distinct from the flavoring agent in the flavor glycoside. In some embodiments, the one or more additional flavoring agents is aerosolized during use of the aerosol provision system prior to the release of the flavoring agent from the flavor glycoside.

According to some embodiments described herein, there is provided the use of a flavor glycoside to increase the water solubility of a flavoring agent in a consumable for an aerosol provision system, wherein the flavor glycoside comprises a flavoring agent bound to a sugar via a glycosidic bond, wherein the increase in water solubility is relative to the flavoring agent not being bound to the sugar via a glycosidic bond.

In each of the uses described herein, the flavor glycoside, consumable, aerosol provision system, delivery of flavor, change of flavor, and additional flavoring agents may be as described hereinabove in respect of the consumable.

Further Broad Aspects

According to some embodiments described herein, there is also provided a consumable for an aerosol provision system comprising (i) at least one flavor glycoside; wherein the flavor glycoside comprises a flavoring agent bound to a sugar via a glycosidic bond; and wherein the flavoring agent is selected from the group consisting of geraniol, citronellol, nerol, maltol, ethylmaltol, fenchol, homofuraneol, furaneol, norfuraneol, 1-octen-3-ol, borneol, linalool, farnesol, hydroxycitronellol, 3,7-dimethyloctanol, myrcenol, lavandulol, nerolidol, terpineol, alpha-terpineol, menthol, thymol, carvacrol, myrtenol, carveol, santalol, piperitol, perillyl alcohol, patchouli alcohol, hexanol, 3-cis-hexanol, phenylethanol, eugenol, sesamol, sotolone, maple furanone, methyl anthranilate, guaiacol, raspberry ketone, and combinations thereof, and (ii) aerosol-generating material. In various embodiments the flavor glycoside may be obtained from a biotechnological process, e.g. an enzymatic process. In various embodiments the consumable comprises greater than 15 wt. % water.

According to some embodiments described herein, there is also provided a consumable According to some embodiments described herein, there is also provided an aerosol provision system comprising a consumable, wherein the consumable comprises (i) at least one flavor glycoside; wherein the flavor glycoside comprises a flavoring agent bound to a sugar via a glycosidic bond; and (ii) aerosol-generating material, wherein no more than 40 wt. % of the flavoring agent is released from the flavor glycoside within about 10 minutes of a user inhaling on the aerosol provision system.

According to some embodiments described herein, there is also provided a consumable comprising (i) at least one flavor glycoside; wherein the flavor glycoside comprises a flavoring agent bound to a sugar via a glycosidic bond; (ii) aerosol-generating material, and (iii) one or more additional flavoring agents that is not bound to a sugar via a glycosidic bond. In some embodiments, the one or more additional flavoring agents is different from the flavoring agent in the flavor glycoside. In some embodiments, the one or more additional flavoring agents is the same as the flavoring agent in the flavor glycoside. In some embodiments, the rate of release of the flavoring agent in the flavor glycoside is slower than the rate of release of the one or more additional flavoring agents, wherein the rate of release is measured as the rate at which a flavoring agent is released during use of the consumable in the aerosol provision system.

The flavor glycoside in such further broad aspects may be obtained by the biotechnological process as described herein. The above-described embodiments and disclosure equally applies to each of these further broad aspects. The combination of these further broad aspects with any of the embodiments described in the present disclosure is therefore specifically envisaged and encompassed by the present disclosure.

EXAMPLES

Aspects of the present invention are more fully illustrated by the following examples, which are set forth to illustrate certain aspects of the present invention and are not to be construed as limiting thereof.

Example 1—Water Solubility of Flavor Glycosides

In this Example, the water-solubility of flavoring agents as flavor glucosides was compared with the water-solubility of the same flavoring agents not in the form of a flavor glucoside. The flavoring agents listed in the table below were obtained commercially, the flavor glycosides were obtained according to the biotechnological process described herein and set out in Example 1 of WO 2015/197844, incorporated herein by reference.

The comparison of water solubility demonstrates the benefits of flavor glycosides as discussed herein for consumables comprising greater than 15. wt % water which are suitable for aerosol provision systems.

| Flavoring Agent | Flavoring Agent water solubility (g/L) | Glucoside water solubility (g/L) | Water solubility comparison (flavouring agent/glucoside) |
|---|---|---|---|
| Furaneol | 18.5 | 731 | 40 |
| Homofuraneol | 6.178 | 749 | 121 |
| Maltol | 10.9 | 535 | 49 |
| Ethylmaltol | 24.23 | 662 | 27 |
| Sotolon | 22.28 | 502 | 23 |
| Maple furanone | 74.39 | 772 | 10 |
| Geraniol | 0.1 | 627 | 6270 |
| Nerol | 0.256 | 16.6 | 65 |
| Citronellol | 0.106 | 519 | 4896 |
| Linalool | 0.68 | 564 | 829 |
| Alpha-Terpineol | 0.71 | 172 | 242 |
| Perillyl alcohol | 0.471 | 485 | 1030 |
| Myrtenol | 0.261 | 525 | 2011 |
| Borneol | 1.186 | 16.4 | 14 |
| Fenchol | 0.461 | 4 | 9 |
| Thymol | 0.9 | 2.68 | 3 |
| Carvacrol | 1.25 | 12.4 | 10 |
| Menthol | 0.49 | 10.2 | 21 |
| Eugenol | 2.46 | 15.1 | 6 |
| 2-Phenylethanol | 21.99 | 833 | 38 |
| Vanillin-Alcohol | 2 | 62 | 31 |
| Raspberry ketone | 13.46 | 472 | 35 |
| Farnesol | 0.00129 | 1 | 775 |
| 1-Octen-3-ol | 1.836 | 200 | 109 |
| cis-3-Hexen-1-ol | 16 | 598 | 37 |
| 1-Hexanol | 5.9 | 676 | 115 |
| Methylanthranilate | 2.85 | 35 | 12 |
| Sesamol | 14.65 | 28 | 2 |

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

SEQUENCE LISTING

```
<160> NUMBER OF SEQ ID NOS: 2

<210> SEQ ID NO 1
<211> LENGTH: 473
<212> TYPE: PRT
<213> ORGANISM: Artificial Sequence
<220> FEATURE:
<223> OTHER INFORMATION: Terpene glycosyl transferase VvGT14

<400> SEQUENCE: 1

Met Gly Ser Met Glu Lys Pro His Ala Val Cys Ile Pro Tyr Pro Ala
1               5                   10                  15

Gln Gly His Ile Asn Pro Met Leu Lys Val Ala Lys Leu Leu His Phe
            20                  25                  30

Arg Gly Phe Arg Ile Thr Phe Val Asn Thr Glu Phe Asn His Thr Arg
        35                  40                  45

Leu Leu Lys Ala Gln Gly Pro Asn Ser Leu Asn Gly Leu Pro Thr Phe
    50                  55                  60

Gln Phe Glu Thr Ile Pro Asp Gly Leu Pro Pro Ser Asn Val Asp Ala
65                  70                  75                  80

Thr Gln Asp Ile Pro Ser Leu Cys Ala Ser Thr Lys Lys Asn Cys Leu
                85                  90                  95

Ala Pro Phe Arg Arg Leu Leu Ala Lys Leu Asn Asp Arg Gly Pro Pro
            100                 105                 110

Val Thr Cys Ile Phe Ser Asp Ala Val Met Ser Phe Thr Leu Asp Ala
        115                 120                 125

Ala Gln Glu Leu Gly Ile Pro Asp Leu Leu Leu Trp Thr Ala Ser Ala
    130                 135                 140

Cys Gly Phe Met Ala Tyr Val Gln Tyr Arg Ser Leu Ile Asp Lys Gly
145                 150                 155                 160

Phe Thr Pro Leu Lys Asp Glu Ser Tyr Leu Thr Asn Gly Tyr Leu Asp
                165                 170                 175

Thr Val Val Asp Trp Ile Pro Gly Met Lys Gly Ile Arg Leu Lys Asp
            180                 185                 190

Leu Pro Ser Phe Ile Arg Thr Thr Asp Pro Asp Asp Ile Met Leu Asp
        195                 200                 205

Phe Ala Met Gly Glu Leu Glu Arg Ala Arg Lys Ala Ser Ala Ile Ile
    210                 215                 220

Phe Asn Thr Phe Asp Ala Leu Glu Gln Glu Val Leu Asp Ala Ile Ala
225                 230                 235                 240

Pro Met Tyr Pro Pro Ile Tyr Thr Ile Gly Pro Leu Gln Leu Leu Pro
                245                 250                 255

Asp Gln Ile His Asp Ser Glu Leu Lys Leu Ile Gly Ser Asn Leu Trp
            260                 265                 270

Lys Glu Glu Pro Glu Cys Leu Lys Trp Leu Asp Ser Lys Glu Pro Asn
        275                 280                 285

Ser Val Val Tyr Val Asn Tyr Gly Ser Ile Thr Val Met Thr Pro Gln
    290                 295                 300

Gln Leu Ile Glu Phe Ala Trp Gly Leu Ala Asn Ser Asn Gln Ser Phe
305                 310                 315                 320

Leu Trp Ile Leu Arg Pro Asp Leu Val Ser Gly Glu Ser Ala Ile Leu
                325                 330                 335
```

```
Pro Pro Glu Phe Val Ala Glu Thr Glu Asp Arg Gly Leu Leu Ala Gly
            340                 345                 350

Trp Cys Pro Gln Glu Gln Val Leu Thr His Gln Ala Ile Gly Gly Phe
        355                 360                 365

Leu Thr His Asn Gly Trp Asn Ser Thr Ile Glu Gly Leu Cys Ala Gly
    370                 375                 380

Val Pro Met Ile Cys Trp Pro Phe Phe Ala Glu Gln Gln Thr Asn Cys
385                 390                 395                 400

Arg Tyr Cys Cys Thr Glu Trp Gly Val Gly Met Glu Ile Asp Ser Asp
                405                 410                 415

Val Lys Arg Asp Glu Val Ala Lys Leu Val Arg Glu Leu Met Val Gly
            420                 425                 430

Glu Lys Gly Lys Val Met Lys Lys Lys Thr Met Glu Trp Lys His Arg
        435                 440                 445

Ala Glu Val Ala Thr Thr Gly Pro Asp Gly Ser Ser Tyr Leu Asn Leu
    450                 455                 460

Glu Lys Ile Phe Glu Gln Val Leu Leu
465                 470


<210> SEQ ID NO 2
<211> LENGTH: 442
<212> TYPE: PRT
<213> ORGANISM: Artificial Sequence
<220> FEATURE:
<223> OTHER INFORMATION: Terpene glycosyl transferase VvGT15

<400> SEQUENCE: 2

Met Pro Arg Arg Val Val Leu Val Pro Cys Pro Phe Gln Gly His Ile
1               5                   10                  15

Asn Pro Met Leu Gln Leu Gly Ala Ile Leu His Ser Arg Gly Phe Ser
            20                  25                  30

Ile Thr Val Ala His Thr Gln Tyr Asn Ser Pro Asp Pro Ser Asn His
        35                  40                  45

Pro Asp Phe Ser Phe Leu Pro Ile Pro Asp Gly Leu Ser Asp Gly Gln
    50                  55                  60

Asn Phe Ala Ser Leu Leu Asn Leu Val Leu Ala Ala Asn Val Asn Cys
65                  70                  75                  80

Glu Ser Pro Leu Arg Glu Tyr Leu Ala Glu Lys Gln Glu Gln His Gly
                85                  90                  95

Asp Ile Ala Cys Ile Ile His Asp Ile Thr Met Tyr Phe Ala Glu Ala
            100                 105                 110

Val Ala Asn His Leu Lys Val Pro Ser Ile Asn Leu Val Thr Ser Asn
        115                 120                 125

Val Ser Thr Thr Ile Ala His Asn Ala Phe Pro Ser Leu Leu Glu Lys
    130                 135                 140

Gly His Ile Pro Leu Gln Gly Ser Thr Leu His Asp Pro Val Pro Glu
145                 150                 155                 160

Leu His Pro Leu Arg Phe Lys Asp Leu Pro Ile Ser Arg Leu Gly Asp
                165                 170                 175

Leu Glu Val Phe Phe Gln Ile Leu Val Asn Met Tyr Lys Lys Lys Phe
            180                 185                 190

Ser Ser Pro Ile Ile Trp Asn Thr Met Asp Cys Leu Glu Gln Ser Ser
        195                 200                 205

Leu Thr Gln Arg Gln Gln Gln Leu Gln Val Pro Phe Phe Pro Ile Gly
    210                 215                 220
```

-continued

```
Pro Leu His Lys Leu Ala Pro Pro Ser Ser Ser Ser Leu Leu Glu Glu
225                 230                 235                 240

Asp Ser Ser Cys Ile Thr Trp Leu Asp Lys Gln Ser Pro Lys Ser Val
                245                 250                 255

Ile Tyr Val Ser Trp Gly Ser Leu Ala Cys Met Asp Ala Lys Asp Leu
            260                 265                 270

Ala Glu Val Ala Trp Gly Leu Ala Asn Ser Asn Gln Pro Phe Leu Trp
        275                 280                 285

Val Val Arg Pro Gly Ser Val Arg Gly Ser Gln Trp Ile Glu Gln Leu
    290                 295                 300

Pro Glu Thr Phe Met Asp Thr Val Gly Glu Arg Cys His Ile Val Lys
305                 310                 315                 320

Trp Ala Pro Gln Lys Glu Val Leu Gly His Arg Ala Val Gly Gly Phe
                325                 330                 335

Trp Ser His Cys Gly Trp Asn Ser Thr Leu Glu Ser Ile Ser Glu Gly
            340                 345                 350

Val Pro Met Ile Cys Arg Pro Tyr Ser Gly Asp Gln Arg Val Asn Thr
        355                 360                 365

Arg Tyr Ile Ser His Val Trp Lys Val Gly Leu Glu Leu Glu Ser Asp
    370                 375                 380

Glu Leu Glu Arg Val Glu Ile Glu Arg Ala Val Arg Arg Leu Met Val
385                 390                 395                 400

Asp Gly Glu Gly Glu Glu Met Arg Gln Arg Ala Met Glu Leu Lys Glu
                405                 410                 415

Lys Val Glu Ile Cys Thr Ser Glu Gly Gly Ser Ser Asn Arg Ala Leu
            420                 425                 430

Lys Glu Leu Val Glu Tyr Ile Ser Ser Phe
        435                 440
```

The invention claimed is:

1. A consumable for an aerosol provision system comprising:

i. at least one flavour glycoside, and ii. aerosol-generating material, wherein the flavour glycoside comprises a flavouring agent bound to a sugar via a glycosidic bond; and wherein the consumable comprises greater than about 15 wt. % water.

2. The consumable according to claim 1, wherein the flavour glycoside is obtained from an enzymatic process.

3. The consumable according to claim 1, wherein the sugar is a monosaccharide or a disaccharide.

4. The consumable according to claim 1, wherein the sugar is a monosaccharide selected from the group consisting of glucose and fructose, optionally wherein the flavour glycoside is a flavour glucoside.

5. The consumable according to claim 1, wherein the flavouring agent is selected from the group consisting of terpenes, aliphatic alcohols, aromatic alcohols, pyrones, lactones, phenylpropanoids, and combinations thereof, optionally wherein the flavouring agent is selected from the group consisting of geraniol, citronellol, nerol, maltol, ethylmaltol, fenchol, homofuraneol, furaneol, norfuraneol, 1-octen-3-ol, borneol, linalool, farnesol, hydroxycitronellol, 3,7-dimethyloctanol, myrcenol, lavandulol, nerolidol, terpineol, alpha-terpineol, menthol, thymol, carvacrol, myrtenol, carveol, santalol, piperitol, perillyl alcohol, patchouli alcohol, hexanol, 1-hexanol, 3-cis-hexanol, cis-hexen-1-ol, phenylethanol, eugenol, sesamol, sotolone, maple furanone, methyl anthranilate, guaiacol, raspberry ketone, 2-methoxy-4-vinylphenol, 4-ethylguajacol, benzylalcohol, phenylmethanol, vanillin, ethylvanillin, and combinations thereof.

6. The consumable according to claim 1, comprising greater than about 25 wt. % water.

7. The consumable according to claim 1, comprising greater than about 40 wt. % water.

8. The consumable according to claim 1, further comprising at least one active ingredient, optionally wherein the active ingredient is selected from the group consisting of nicotine, caffeine, taurine, theine, vitamins such as B6 or B12 or C, melatonin, cannabinoids, or constituents, derivatives, or combinations thereof.

9. The consumable according to claim 1, wherein the consumable is nicotine-free.

10. The consumable according to claim 1, wherein the flavour glycoside is present in an amount of from about 0.001 to about 20 wt¾ of the consumable, optionally from about 0.01 to about 6 wt % of the consumable.

11. The consumable according to claim 1, further comprising one or more additional flavouring agents, wherein the one or more additional flavouring agents is optionally different from the flavouring agent in the flavour glycoside or the one or more additional flavouring agents is the same as the flavouring agent of the flavour glycoside.

12. The consumable according to claim 11, wherein the rate of release of the flavouring agent in the flavour glycoside is slower than the rate of release of the one or more additional flavouring agents, wherein the rate of release is measured as the rate at which a flavouring agent is released during use of the consumable in the aerosol provision system.

13. The consumable according to claim 1, wherein the consumable is a liquid or a gel.

14. An aerosol provision system comprising the consumable according to claim 1, optionally wherein the aerosol provision system is a non-combustible aerosol provision system.

15. The aerosol provision system of claim 14, wherein no more than 40 wt. % of the flavouring agent is released from the flavour glycoside within about 10 minutes of the user inhaling on the aerosol provision system.

16. A process for preparing a consumable as defined in claim 1, the process comprising:

a. providing aerosol-generating material and at least one flavour glycoside, wherein the flavour glycoside comprises a flavouring agent bound to a sugar via a glycosidic bond; and b. contacting the aerosol-generating material and the at least one flavour glycoside to provide the consumable, wherein the consumable comprises greater than about 15 wt. % water.

17. The consumable according to claim 1 wherein the flavour glycoside is obtained from a biotechnological process.

* * * * *